US005440376A

United States Patent [19]

Hagihara

[11] Patent Number: 5,440,376

[45] Date of Patent: Aug. 8, 1995

[54] ELECTROPHOTOGRAPHIC APPARATUS

[75] Inventor: Hideaki Hagihara, Nara, Japan

[73] Assignee: Sharp Kabushiki Kaisha, Osaka, Japan

[21] Appl. No.: 45,053

[22] Filed: Apr. 7, 1993

[30] Foreign Application Priority Data

Apr. 7, 1992 [JP] Japan ..... 4-085647
Apr. 7, 1992 [JP] Japan ..... 4-085648
Apr. 7, 1992 [JP] Japan ..... 4-085652

[51] Int. Cl.[6] ..... G03G 21/12

[52] U.S. Cl. ..... 355/245; 355/200; 355/260; 355/298

[58] Field of Search ..... 355/200, 210, 260, 298, 355/245; 222/DIG. 1

[56] References Cited

U.S. PATENT DOCUMENTS

| | | | |
|---|---|---|---|
| 4,030,824 | 6/1977 | Smith | 355/298 |
| 4,462,677 | 7/1984 | Onoda . | |
| 4,565,435 | 1/1986 | Hart | 355/245 X |
| 4,768,055 | 8/1988 | Takamatsu et al. | 355/298 |
| 4,891,671 | 1/1990 | Iwamasa | 355/245 |
| 4,891,673 | 1/1990 | Buell | 355/245 |
| 5,095,338 | 3/1992 | Hayes, Jr. et al. . | |
| 5,128,724 | 7/1992 | Hayashi et al. | 355/298 |
| 5,204,720 | 4/1993 | Ishida et al. | 355/260 |
| 5,223,938 | 6/1993 | Mizutani et al. | 355/208 |
| 5,289,241 | 2/1994 | Sugiyama et al. | 355/260 |

FOREIGN PATENT DOCUMENTS

| | | |
|---|---|---|
| 2061 | 1/1984 | Japan . |
| 2596 | 1/1985 | Japan . |
| 1-159681 | 6/1989 | Japan . |
| 267683 | 10/1989 | Japan . |
| 21591 | 5/1990 | Japan . |
| 4-116583 | 4/1992 | Japan . |
| 4-366877 | 12/1992 | Japan . |

*Primary Examiner*—A. T. Grimley
*Assistant Examiner*—Nestor R. Ramirez
*Attorney, Agent, or Firm*—David G. Conlin; George W. Neuner; Brian Michaelis

[57] ABSTRACT

In an electrophotographic apparatus according to the present invention, carrier is gradually supplied to a developing device and a developer is gradually discharged from the developing device through a developer discharge opening. The upper body of a copying machine is free to move upward round a supporting point. The developer discharge opening is formed in a portion of the developing device remotest from the supporting point. This arrangement prevents the developer from spilling from the developer discharge opening when the upper body of the copying machine is opened. Moreover, the developer discharge opening is provided with a shutter device which closes the developer discharge opening (1) when opening the upper body of the copying machine, (2) when removing the developing device from the copying machine, (3) when removing a waste container from the developing device, or (4) for a predetermined period during a copying operation. Consequently, there is no need to concern about spilling the developer from the developer discharge opening, and the developer is easily maintained and handled.

36 Claims, 37 Drawing Sheets

ELECTROPHOTOGRAPHIC APPARATUS

FIELD OF THE INVENTION

The present invention relates to an electrophotographic apparatus having a developing device capable of maintaining a uniform development characteristic of a two-component developer without periodically replacing the developer.

BACKGROUND OF THE INVENTION

A developing device which develops an electrostatic latent image with a two-component developer including carrier and toner is widely used in copying machines as electrophotographic apparatuses. When developing the image, the toner is consumed, while the carrier is not consumed and remains in the developing device. In the developing device, carrier and toner are continually mixed. This causes a resin coating layer to be separated from the carrier surface and the toner to adhere to the carrier surface. As a result, the charging rate of the developer gradually decreases as illustrated in the curved line (b) of FIG. 39. In order to prevent the decrease in the charging rate, the carrier is usually replaced periodically.

The charging rate of the carrier just before replacement is far below that of a newly replaced carrier. Thus, with the method which requires periodical replacement of the carrier, the image quality varies significantly before and after the replacement of the carrier. In addition, replacing the carrier periodically by removing old carrier from and filling the developing device with new carrier is a time consuming task and unhygienic as the toner spills from the developing device and rises. To solve such a problem, a trickle-type developing device which gradually discharges the carrier from the developing device and supplies new carrier to the developing device is proposed.

Typical trickle-type developing devices are disclosed, for example, in Japanese Publication for Examined Patent Application No. 21591/1990, Japanese Publication for Examined Utility Model Application No. 2596/1985, and Japanese Publication for Unexamined Patent Application No. 267683/1989. With such a developing device, a new developer is gradually supplied from a developer supply to the developing device. When the amount of the developer in the developing device increases excessively, the old developer overflows from the developer discharge opening into a waste container.

With such a developing device, new developer is gradually added, while old developer is gradually discharged. Therefore, as illustrated in the curved line (a) of FIG. 39, the charging rate of the developer becomes substantially uniform after it has been used for a predetermined period of time. However, the charging rate of the developer decreases to a certain extent until it will have been used for a predetermined time after the addition of the new developer to the developing device. Another advantage of this developing device is that the waste container is needed to be replaced only when the waste container is fill up with the old developer. Namely, it is not necessary to replace the carrier periodically according to the deterioration of the carrier. Moreover, since only the waste container is replaced, a reduced amount of toner rises during replacement.

In a clamshell-type copying machine, the sheet transport path is exposed by moving the upper body of the copying machine round the supporting point. The supporting point is located on an end of the copying machine, adjacent to the developer discharge opening of the developing device (see, for example, FIG. 1 of Japanese Publication for Unexamined Patent Application No. 267683/1989). On the other hand, in the conventional trickle-type developing device, the developer discharge opening is always open and ready to discharge the used developer. With this structure, for example, if the developer tilts as a result of opening the upper body of the copying machine to remove a jammed sheet, the developer in the developing device moves toward the developer discharge opening. This causes the developer to be unnecessarily discharged from the developer discharge opening.

Moreover, the conventional structure is designed without fully considering the handling of the developer when loading/unloading the developing device and when discarding the developer. Therefore, there is room for improvement.

Furthermore, with the conventional structure, excessive developer is discharged from the developer discharge opening into the waste container when, for example, a movement of the copying machine gives an impact on the developing device.

SUMMARY OF THE INVENTION

An object of the present invention is to provide an electrophotographic apparatus including a trickle-type developing device which is structured such that, even when the developing device tilts or receives an impact, a developer does not spill unnecessarily from a developer discharge opening formed in the developing device.

Another object is to provide an electrophotographic apparatus including a trickle-type developing device which enables a waste container filled up with a deteriorated developer to be easily replaced without concerning about spilling the developer from the waste container.

Still another object is to provide an electrophotographic apparatus with a trickle-type developing device, which has a simplified structure but is capable of opening and closing the developer discharge opening according to necessity.

Other object is to provide an electrophotographic apparatus with a trickle-type developing device, enabling easy maintenance of the developer.

In order to achieve the above objects, an electrophotographic apparatus of the present invention at least includes:

(1) transport path means for transporting a copy material;

(2) an upper body which is moved upward round a supporting point to expose the transport path means; and (3) developing means for developing an electrostatic latent image with a developer including toner and carrier, wherein (a) the developing means includes a first section near the supporting point and a second section located far from the supporting point, (b) the developing means is installed in the upper body, (c) the carrier is gradually supplied to the developing means and the developer is gradually discharged through a developer discharge opening of the developing means, and (d) the developer discharge opening is formed in the second section.

With this arrangement, even when the developing means tilts as a result of the upward movement of the upper body and the developing means, the developer gathers around the first section in the developer. Since the developer discharge opening is formed in the second section located far from the supporting point, even when the developing means tilts or when the developing means receives an impact, the developer does not spill unnecessarily from the developer discharge opening.

The upper body of the copying machine is needed to be opened, for example, when removing a jammed sheet from the transport path means.

In order to achieve the above objects, another electrophotographic apparatus of the present invention includes (4) shutter means as well as the means described in (1), (2) (3)-(b)(c).

The shutter means closes the developer discharge opening by the movement of the upper body to expose the transport path means, and opens the developer discharge opening as the upper body is moved back to a former position to cover the transport path means.

With this arrangement, the developer discharge opening is covered or uncovered by simply opening or closing the upper body of the copying machine. It is thus possible to prevent such a movement of the upper body from causing the developer to spill from the developer discharge opening.

Additionally, if the shutter means is structured to function as a lock mechanism for preventing the upper body from being opened, there is no need to provide a lock mechanism separately.

In order to achieve the above objects, still another electrophotographic apparatus of the present invention at least includes:

(1) developing means for developing an electrostatic latent image with a developer including toner and carrier, wherein (a) the developing means is attachable to and detachable from the electrophotographic apparatus, and (b) the carrier is gradually supplied to the developing means, and the developer is gradually discharged from a developer discharge opening formed in the developing means; and (2) shutter means which opens the developer discharge opening by the installation of the developing means in the electrophotographic apparatus and closes the developer discharge opening by the removal of the developing means from the electrophotographic apparatus.

With this arrangement, the developer discharge opening is covered or uncovered by simply installing or removing the developing means in/from the electrophotographic apparatus. Since the developer discharge opening is certainly closed when removing the developing means, the developing means is easily replaced or transported without concerning about spilling the developer. Thus, an electrophotographic apparatus with this arrangement enables the developer to be handled easily.

It is still possible to open or close the developer discharge opening by the installation or removal of the developer collecting means storing a deteriorated developer in/from the developing means instead of the installation or removal of the developing means in/from the electrophotographic apparatus.

Moreover, if developer collecting opening is formed at a position of the developer collecting means corresponding to the developer discharge opening, it is possible to arrange the shutter means to open or close the developer discharge opening and the developer collecting opening simultaneously when installing or removing the developer collecting means in/from the developing means.

This arrangement prevents the developer from spilling unnecessarily from the developer discharge opening and the developer collecting opening when replacing or transporting the developer collecting means filled with the deteriorated developer. Accordingly, an electrophotographic apparatus with this arrangement enables the developer to be handled more easily.

In order to achieve the above objects, still another electrophotographic apparatus of the present invention at least includes:

(1) developing means for developing an electrostatic latent image formed on a photoreceptor with a developer including toner and carrier, the developing means having a developer discharge opening for supplying the carrier gradually to the developing means;

(2) cleaning means for collecting a used developer remaining on the surface of the photoreceptor;

(3) developer collecting means for storing the used developer and the deteriorated developer which has been gradually discharged through the developer discharge opening; and (4) transport path means for transporting the used developer from the cleaning means to the developer collecting means.

With this arrangement, since the used developer collected by the cleaning means is transported to the developer collecting means by the transport path means, there is no need to replace the cleaning means. In other words, only the developer collecting means is needed to be replaced when it is filled up with the developer. Thus, the developer is maintained and handled more easily. Furthermore, since the cleaning means is not required to store the used developer, it is possible to reduce the size. On the other hand, although the developer collecting means is needed to be build larger than conventional developer collecting means, it is disposed in any available space. Accordingly, the size of the copying machine is reduced by reducing the size of the cleaning means.

In order to achieve the above objects, other electrophotographic apparatus of the present invention at least includes:

(1) developing means for developing an electrostatic latent image with a developer including toner and carrier, wherein the carrier is gradually supplied into the developing means and the developer is gradually discharged from a developer discharge opening formed in the developing means;

(2) shutter means for opening and closing the developer discharge opening;

(3) shutter driving means for moving the shutter means between a first position and a second position, wherein (a) the shutter means closes the developer discharge opening at the first position, and (b) the shutter means opens the developer discharge opening at the second position; and (4) controller means for controlling the shutter driving means to move the shutter means from the first position to the second position only in a predetermined period during a copying operation.

With this arrangement, the developer discharge opening is uncovered only for a predetermined period during a copying operation according to the necessity by the shutter means, the shutter driving means and the controller means. It is therefore possible to minimize the possibility of spilling the developer unnecessarily from the developer discharge opening.

For example, the predetermined period may be set to a period which starts when a motor is started to drive the developing means and ends when the motor is stopped, or which starts when the controller means receives an instruction to start the copying operation and ends when the motor is stopped. It is also possible to measure a period during which the developer discharge opening is uncovered by using a timer based on a time at which the instruction was input to the controller means.

For a fuller understanding of the nature and advantages of the invention, reference should be made to the ensuing detailed description taken in conjunction with the accompanying drawings.

DESCRIPTION OF THE EMBODIMENTS

EMBODIMENT 1

With reference to FIGS. 1 through 5, the following description discusses a first embodiment of the present invention, wherein an electrophotographic apparatus of the present invention is adopted in a copying machine.

Figure 1:
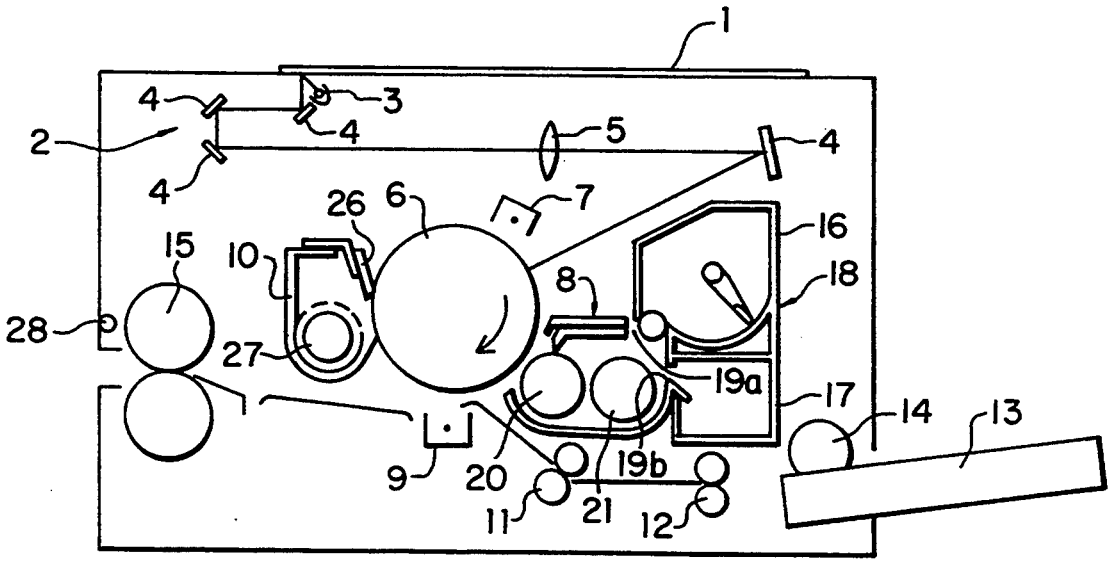
FIG. 1 schematically illustrates an overall structure of a copying machine according to a first embodiment of the present invention.

As illustrated in FIG. 1, the copying machine includes a document platen 1 mounted on the top surface thereof and an optical system 2 disposed below the document platen 1. The optical system 2 is constituted by a lamp 3 as a light source, a plurality of reflecting mirrors 4, and a lens unit 5. The lamp 3 scans a document (not shown) placed on the document platen 1 by illuminating light thereon. The reflecting mirrors 4 direct reflected light from the document to a photoreceptor 6 disposed near the center of the copying machine. The lens unit 5 is disposed on the path of the reflected light traveling from the document to the photoreceptor 6.

Disposed around the photoreceptor 6 are a charger 7 for charging the surface of the photoreceptor 6 to a predetermined potential, an image spacing eraser (not shown), a developing device 8, a transfer charger 9, a cleaning device 10, an erasing device (not shown). The developing device 8 develops an electrostatic latent image formed on the surface of the photoreceptor 6 into a toner image. The transfer charger 9 transfers the toner image to a sheet. The cleaning device 10 collects the toner remaining on the surface of the photoreceptor 6 after transfer.

Arranged on a transport path through which the sheet is supplied to the photoreceptor 6 are a sheet cassette 13, a feed roller 14, transport rollers 12, and timing rollers 11 for timely supplying the sheet to the photoreceptor 6. A fusing device 15 for fixing the transferred toner image onto the sheet is disposed on a path through which the sheet from the photoreceptor 6 is discharged.

Figure 2:
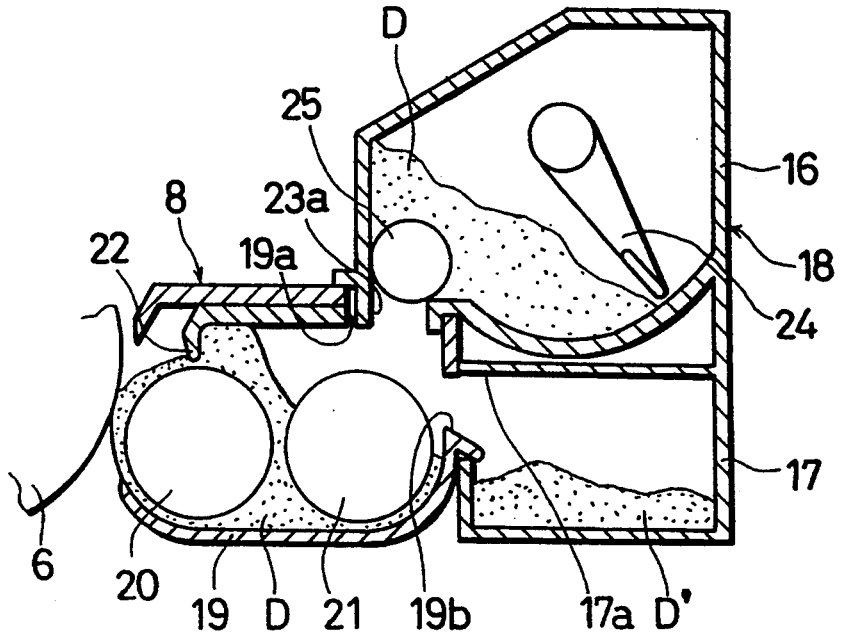
FIG. 2 illustrates an enlarged vertical section of the developing device and of the unit shown in FIG. 1.

As illustrated in FIG. 2, the developing device 8 includes a developer container 16 for storing unused developer D and a waste container 17 for collecting waste developer D'. The developer container 16 and the waste container 17 are integrated into a unit 18. The unit 18 is detachable from the developing device 8.

The developing device 8 also includes a reservoir 19 in which a magneto roller 20 and an agitating roller 21 are installed. The developer D in the reservoir 19 is supplied from the developer container 16. The developer D is composed of, for example, carrier and toner, and has a higher toner density compared to the waste developer D'. The carrier is composed of a magnetic substance and coated with a resin which restrains the toner from adhering to the surface of the carrier. When the carrier is mixed with the toner, the toner is charged with frictional electricity. This causes the toner to adhere to the electrostatic latent image on the photoreceptor 6. The magneto roller 20 transports the carrier while forming a magnetic brush by attracting thereto the carrier with a magnetic force. The toner is attracted to the carrier by Coulomb's force, and supplied to the photoreceptor 6 by the magnetic brush. The length of the magnetic brush is restricted by a doctor 22. The agitating roller 21 agitates the developer D in the reservoir 19.

Figure 3:
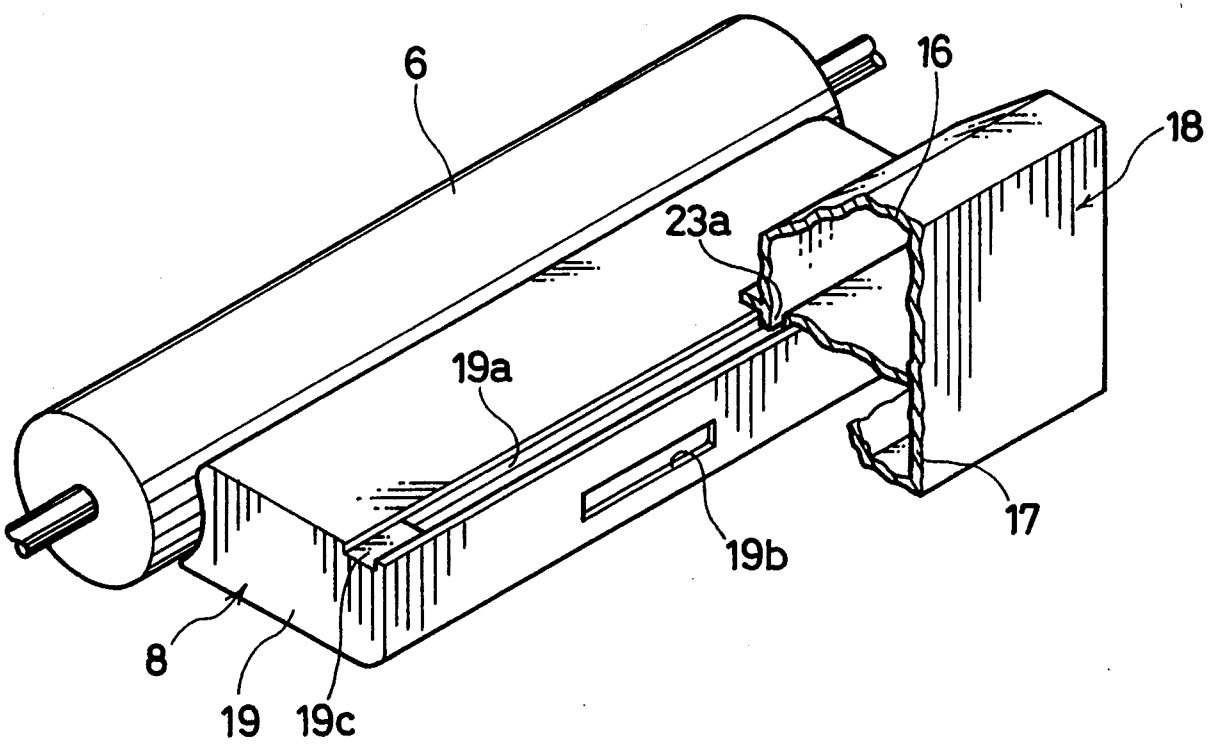
FIG. 3 is a perspective view illustrating a developer discharge opening formed in the developing device and how the unit fits into the developing device by sectionally showing the unit.

The reservoir 19 has a developer intake opening 19*a* and a developer discharge opening 19*b* (see FIGS. 2 and 3). When the unit 18 is installed in the developing device 8, the developer intake opening 19*a* is connected to a developer supply opening 23*a* of the developer container 16, while the developer discharge opening 19*b* is connected to a developer collecting opening 17*a* of the waste container 17. The developer discharge opening 19*b* is formed on one side of the reservoir 19 which is farther from a supporting point 28 shown in FIG. 1 than the other other side is from the supporting point 28 as to be described later. As illustrated in FIG. 3, the developer intake opening 19*a* is formed in a grooved section 19*c* on the top surface of the reservoir 19. When installing the unit 18 in the developing device 8, the developer supply opening 23*a* fits into the grooved section 19*c*.

As illustrated in FIG. 2, the developer container 16 has therein a supplementary arm 24 and a supplementary roller 25. The supplementary roller 25 rotates and gradually supplies the developer D from the developer supplying opening 23*a* to the reservoir 19. The waste container 17 has the developer collecting opening 17*a* formed in the upper portion of the side wall adjacent to the reservoir 19. According to the amount of the developer D supplied from the developer container 16 to the reservoir 19, the waste developer D' is discharged into the waste container 17 by overflow through the developer discharge opening 19*b* and developer collecting opening 17*a*.

As illustrated in FIG. 1, the cleaning device 10 includes a cleaning blade 26 and a transport screw 27. The cleaning blade 26 scrapes off the toner remaining on the surface of the photoreceptor 6. The transport screw 27 transports into one direction the used toner collected by the cleaning blade 26.

Figure 4:
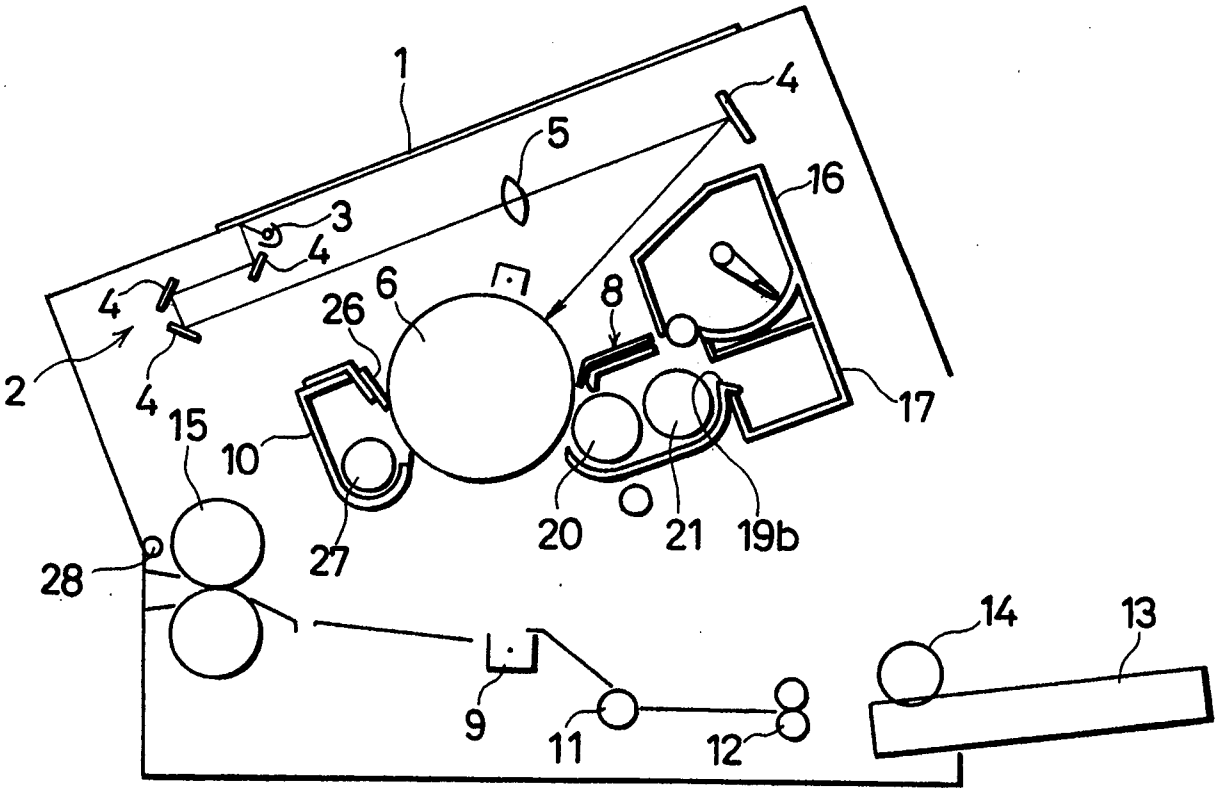
FIG. 4 schematically illustrates an overall structure of the copying machine of FIG. 1, wherein the upper body of the copying machine is opened.

As illustrated in FIG. 4, this copying machine is of a so-called clamshell type and the upper body thereof swings round the supporting point 28 when opened. For instance, when the upper body is opened to remove a jammed sheet, the transport path is exposed. The supporting point 28 is positioned at the end of the copying machine on the discharge side.

According to such a configuration of the copying machine, the following description briefly discusses its copying operation.

In the standby state where the copying machine is warmed up, when the start switch (not shown) is turned ON, a document placed on the document platen 1 is scanned by the lamp 3. Reflected light from the document is directed to the photoreceptor 6 through the reflecting mirrors 4 and the lens unit 5. As a result, an electrostatic latent image is formed on the surface of the photoreceptor 6 which has been charged to have a predetermined potential by the charger 7. The electrostatic latent image is developed by toner supplied by the developing device 8. The toner image on the surface of the photoreceptor 6 is transferred by the transfer charger 9 to a sheet supplied by the sheet cassette 13, and then fixed on the sheet by heating in the fusing device 15. A copied image corresponding to the image on the document is thus formed on the sheet.

The toner remaining on the surface of the photoreceptor 6 is scraped off into the cleaning device 10 by the cleaning blade 26 at the time the transfer process is conducted.

During the copying operation, if a sheet is jammed, as illustrated in FIG. 4, the upper body of the copying machine is moved upward round the supporting point 28. And the upper body is closed after removing the jammed sheet.

Figure 5:
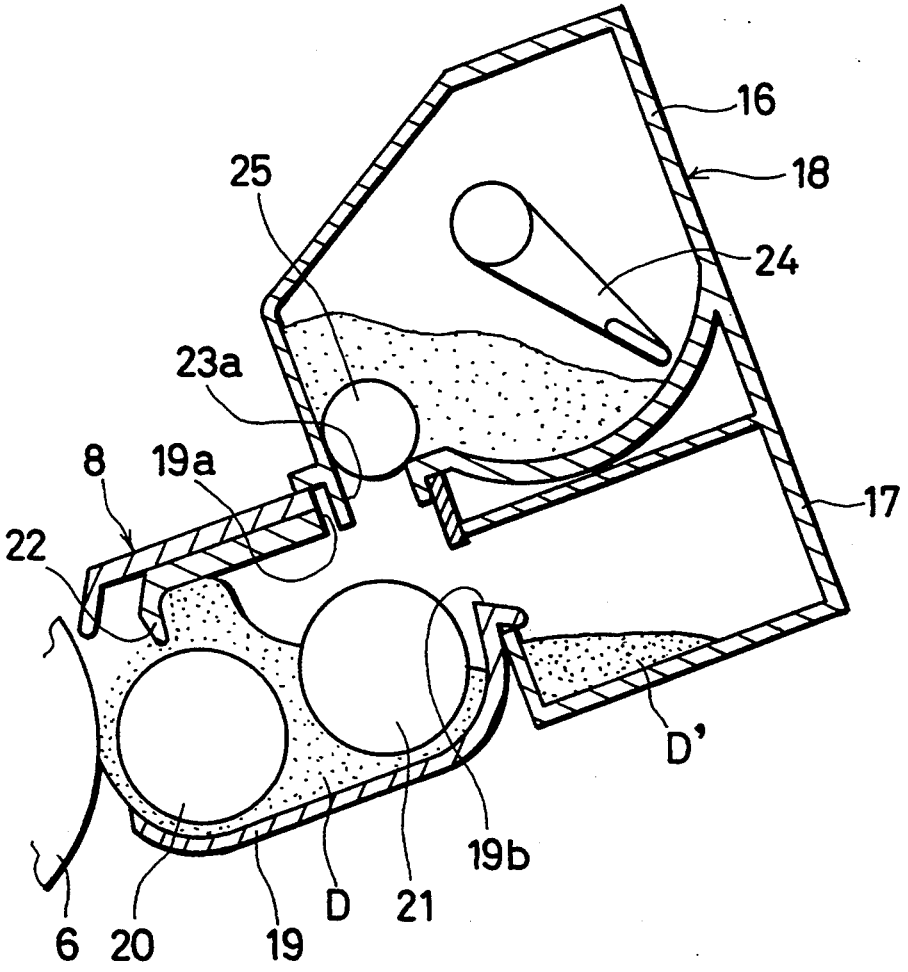
FIG. 5 illustrates an enlarged vertical section of the developing device and of the unit when the copying machine is in a state shown in FIG. 4.

When the upper body of the copying machine is opened, the developing device 8 tilts. Since the developer discharge opening **19*b* is formed on one side of the reservoir 19 which is more distant from the supporting point 28 than the other side is from the supporting point 28, the developer D in the reservoir 19 gathers on a side opposite to the developer discharge opening 19*b* as shown in FIG. 5. Therefore, even when the developing device 8 tilts at the time the upper body of the copying machine is opened, the developer D is not unnecessarily discharged from the developer discharge opening 19*b* into the waste container 17**.

This arrangement prevents the developer D from spilling from the developer discharge opening **19*b* on the impact of opening the upper body of the copying machine. Moreover, since a shutter mechanism which opens and closes the developer discharge opening 19*b* is not incorporated, the above-mentioned advantages are obtained without increasing the costs. Furthermore, it is possible to replace the unit 18 without worrying about spilling the developer D from the developer discharge opening 19*b*** in either case where the upper body of the copying machine is opened or closed.

EMBODIMENT 2

The following description discusses a second embodiment of the present invention with reference to FIGS. 6 through 10. The members having the same function as in the above-mentioned embodiment are designated by the same code and their description is omitted.

Figure 6:
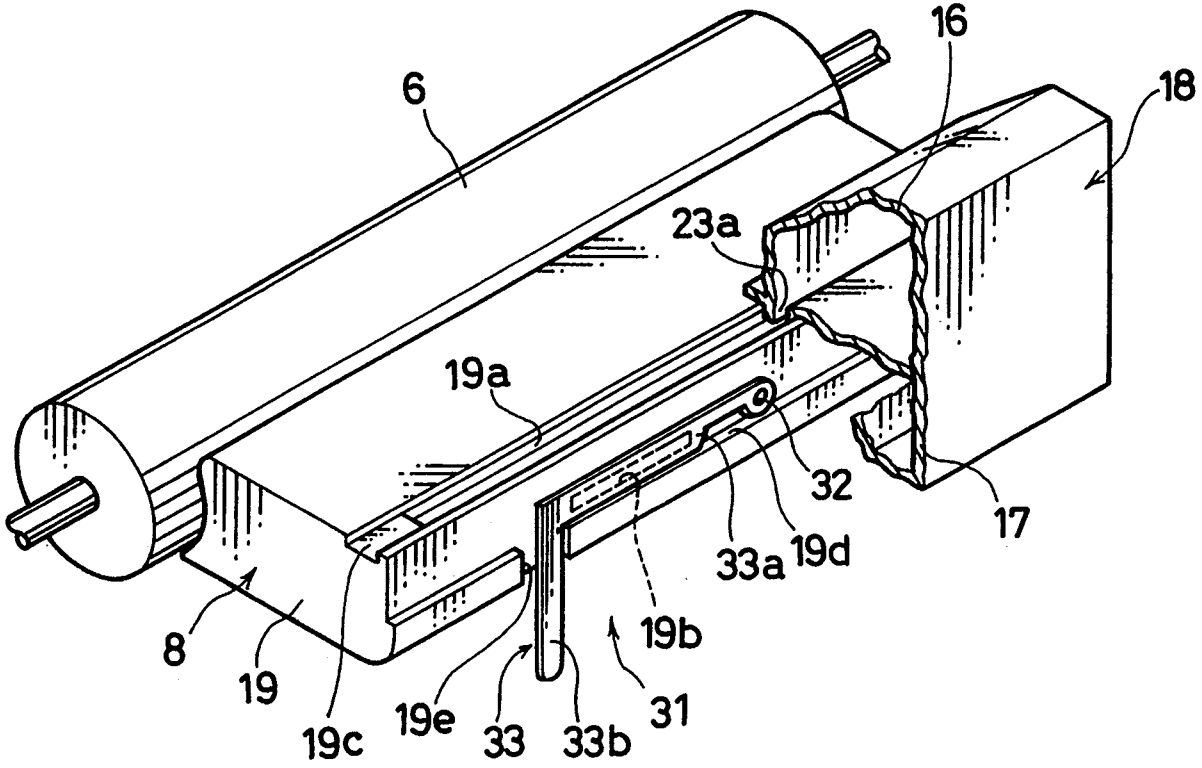
FIG. 6 is a perspective view of a second embodiment of the present invention, illustrating a shutter device installed in the developing device by sectionally showing the unit.

As illustrated in FIG. 6, a copying machine according to this embodiment has a shutter device 31 for opening and closing the developer discharge opening **19*b* of the developing device 8. The shutter 31** device includes:

(1) a shutter member 33 for opening and closing the developer discharge opening **19*b***;

(2) a shaft 32 for supporting the shutter member 33 so that the shutter member 33 is freely pivotable;

(3) a supporting member 19d for supporting the shutter member 33 at a position where the shutter member 33 closes the developer discharge opening **19*b* (hereinafter referred to as a closing position); and (4) a base member 34** as a driving member to be described later.

The shutter member 33 is attached to the reservoir 19 with the shaft 32, and is freely pivotable in a clockwise direction (in a direction to open the developer discharge opening **19*b*) and in a counterclockwise direction (in a direction to close the developer discharge opening 19*b*). The supporting member 19*d* is located below the developer discharge opening 19*b* and protrudes like a step toward the waste container 17. The supporting member 19*d* stops at the closing position the shutter member 33** from moving counterclockwise due to its own weight.

Figure 8:
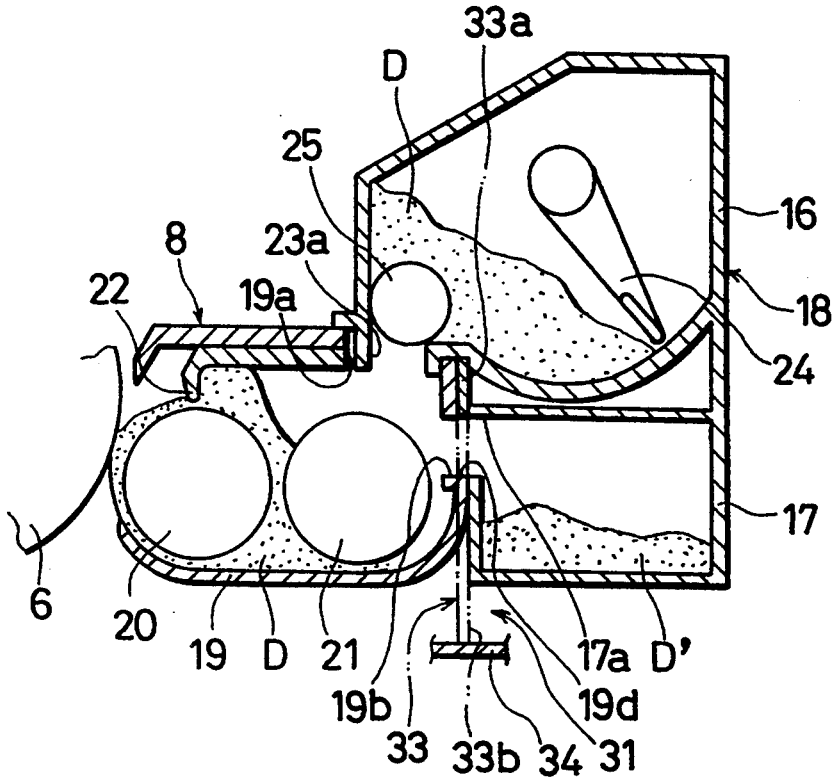
FIG. 8 is a vertical sectional view illustrating how the shutter device operates when the upper body of the copying machine is closed.

The shutter member 33 further includes a cover section **33*a* for opening and closing the developer discharge opening 19*b* and an extension section 33*b* extending downward from an end of the cover section 33*a*. As illustrated in FIG. 8, when the upper body of the copying machine is closed, the extension section 33*b* comes into contact with the base member 34 fixed below the developing device 8 and pushes up the cover section 33*a*. The base member 34 is mounted in the fixed lower body of the copying machine with a suitable member. Also, as illustrated in FIG. 6, a grooved section 19*e* is formed in the supporting member 19*d* so that the extension section 33*b*** is movable in a vertical direction.

Figure 7:
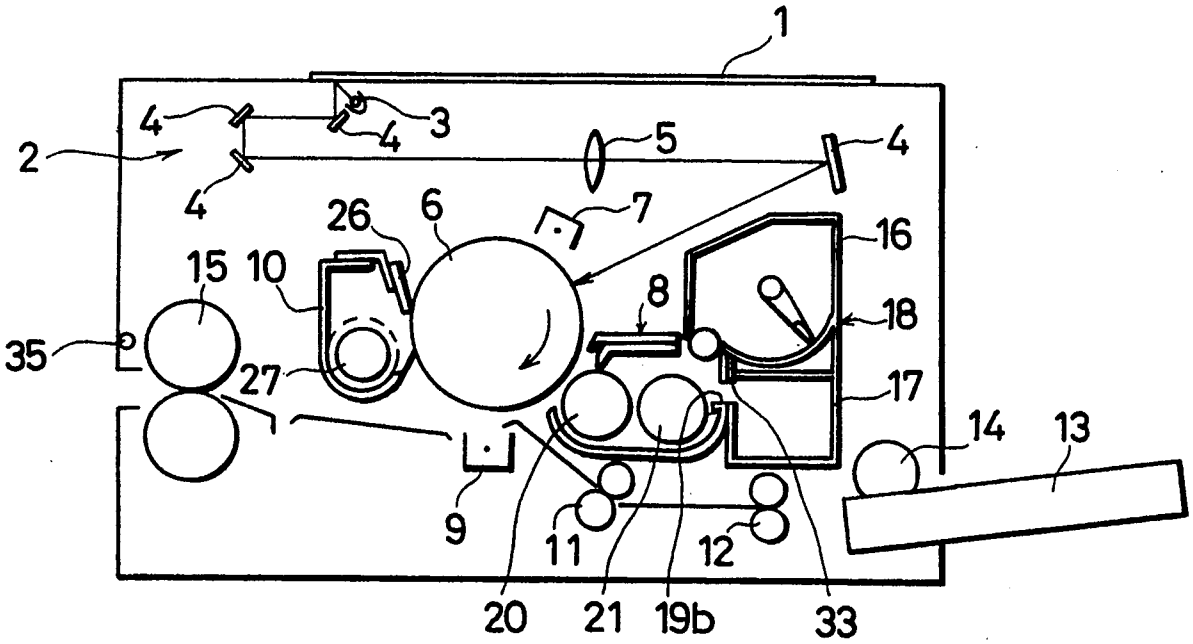
FIG. 7 schematically illustrates an overall structure of a copying machine including the shutter device.
Figure 9:
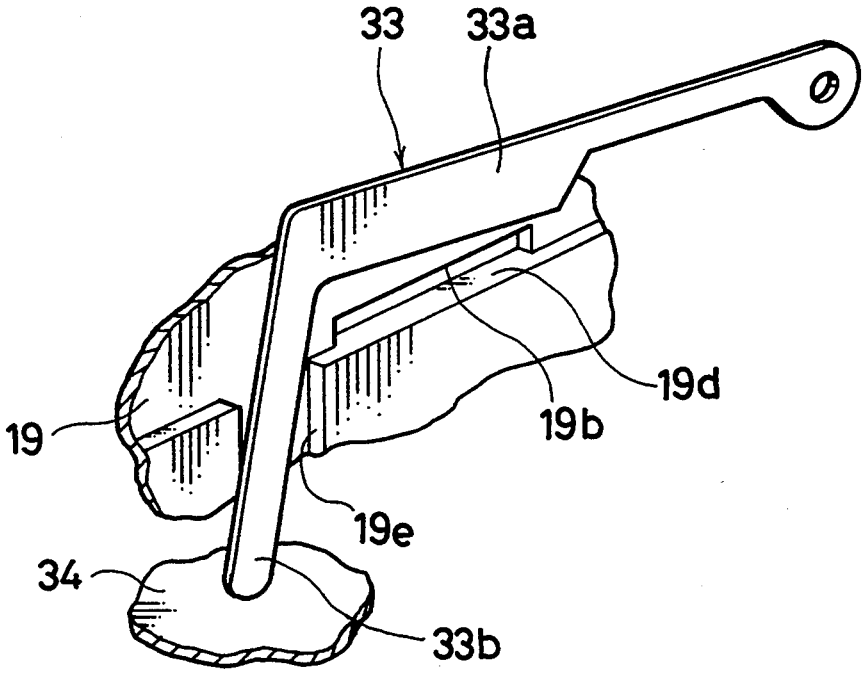
FIG. 9 is a perspective view illustrating the mechanism of the shutter device of FIG. 8.

According to this configuration, under normal conditions where the upper body of the copying machine is closed as illustrated in FIG. 7, the extension section **33*b* of the shutter member 33 is in contact with the base member 34 as shown in FIGS. 8 and 9. This causes the cover section 33*a* to be pushed up so as to open the developer discharge opening 19*b*. Consequently, the developer D becomes ready to be discharged from the developing device 8 into the waste container 17 through the developer discharge opening 19*b***.

Figure 10:
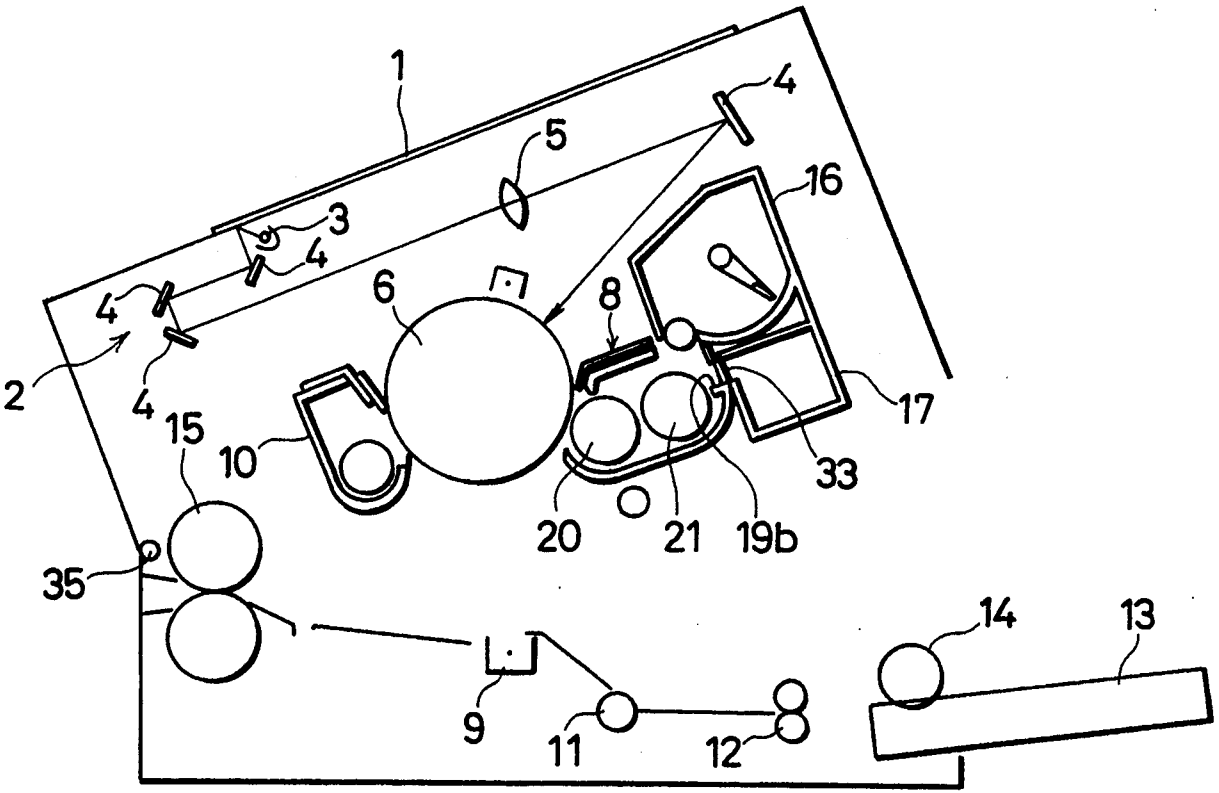
FIG. 10 schematically illustrates an overall structure of the copying machine of FIG. 7, wherein the upper body of the copying machine is opened.

On the other hand, for example, when the upper body of the copying machine is opened to remove a jammed sheet, the shutter member 33 is moved upward together with the upper body of the copying machine as shown in FIG. 10. As a result, the extension section **33*b* comes out of contact with the base member 34. This causes the shutter member 33 to move downward due to its own weight until the cover section 33*a* comes into contact with the supporting member 19*d* and closes the developer discharge opening 19*b* as illustrated in FIG. 6**.

As described above, in this copying machine, since the developer discharge opening **19*b* is closed when the upper body of the copying machine is opened, it is possible to prevent the developer D from being discharged unnecessarily from the developer discharge opening 19*b* by the impact on or a tilt of the developing device 8 caused when the upper body of the copying machine is moved. The replacement of the unit 18 is available in either state where the upper body of the copying machine is opened or closed. Further, when transporting the developing unit 8 after removing it from the copying machine, the developer discharge opening 19*b* is closed by the shutter member 33. This arrangement prevents the developer D from spilling from the developer discharge opening 19*b***.

The shutter device 31 links the opening and closing of the developer discharge opening **19*b* with the upward and downward movements of the upper body of the copying machine by using the weight of the shutter member 33. Such a simplified structure enables a reduction in the cost of the shutter device 31**.

The shutter member 33 may also be designed to be moved in a direction of closing the developer discharge opening **19*b*** by forces of a spring, for example, instead of its own weight.

It is also possible to connect the extension section **33*b* pivotally to the cover section 33*a* with some member. In this case, the extension section 33*b* slides upward and downward along the grooved section 19*e*. Namely, the grooved section 19*e* functions as a sliding guide section for the extension section 33*b*. Furthermore, it is also possible to design the extension section 33*b* as a part of the base member 34**.

EMBODIMENT 3

The following description discusses a third embodiment of the present invention with reference to FIGS. 11 through 14.

The members having the same function as in the above-mentioned embodiment are designated by the same code and their description is omitted.

Figure 11:
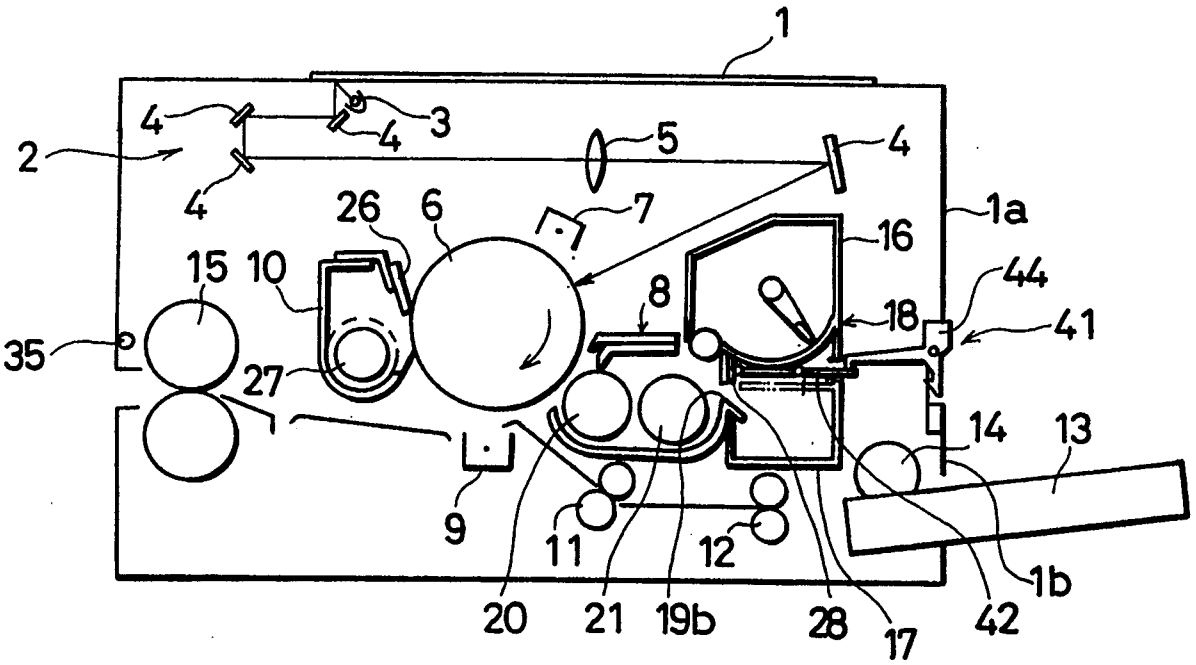
FIG. 11 schematically illustrates an overall structure of a copying machine according to a third embodiment of the present invention.
Figure 12:
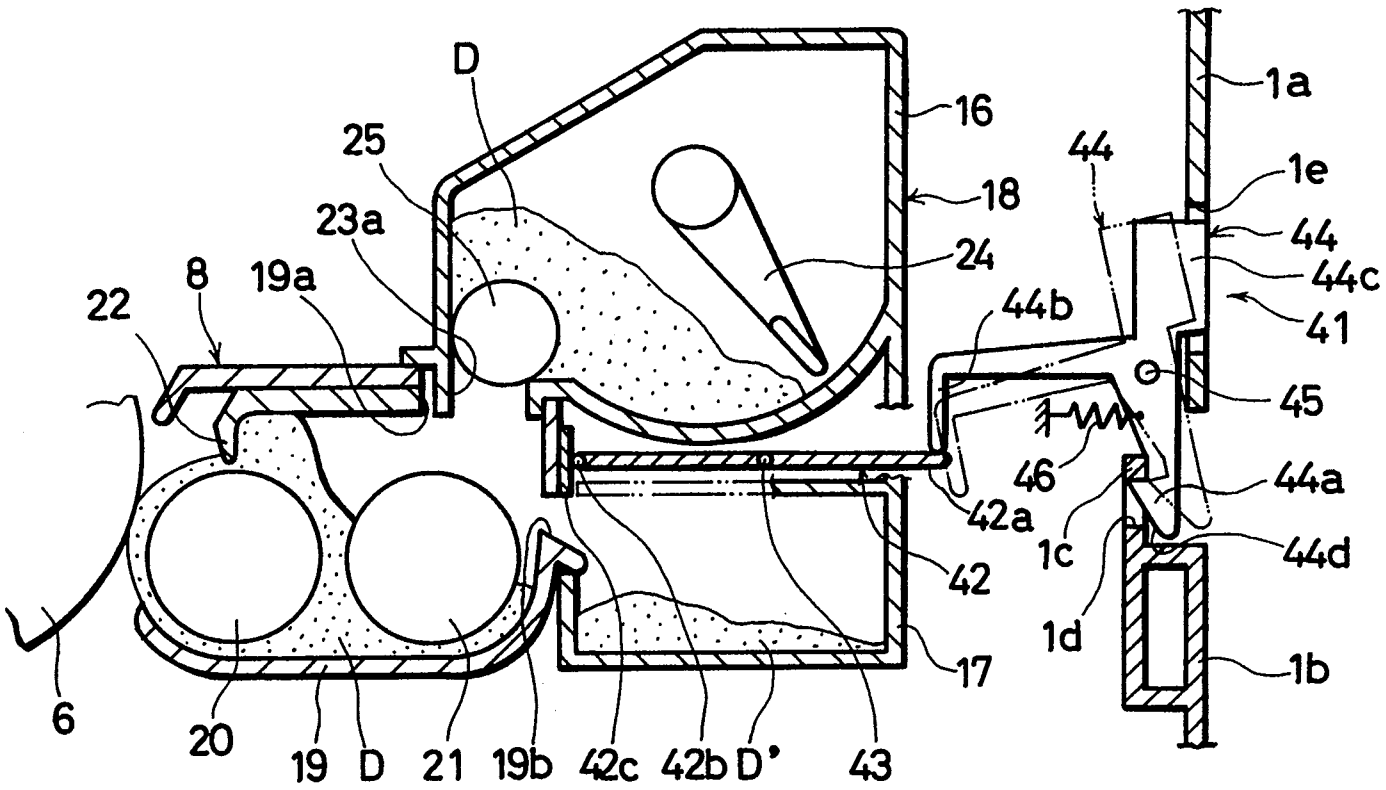
FIG. 12 is an enlarged vertical sectional view illustrating how the shutter device operates when the upper body of the copying machine of FIG. 11 is closed.

As illustrated in FIG. 11, a copying machine according to this embodiment has a shutter device 41 for opening and closing the developer discharge opening 19*b*. As shown in FIG. 12, the shutter device 41 includes:

(1) a movable member 42 installed in the unit 18;

(2) a shaft 43 for supporting the movable member 42 to be pivotable;

(3) a driving member 44, disposed in an upper housing member 1*a* of the copying machine, for controlling the opening and closing of the developer discharge opening 19*b;*

(4) a shaft 45 for supporting the driving member 44 to be pivotable (5) a tension spring 46 for pulling the driving member 44 so that the driving member 44 moves clockwise in FIG. 12; and (6) a joint section 1*c* with a locking hole 1*d*, formed in a lower housing member 1*b* of the copying machine.

The movable member 42 includes a lever 42*a* and a shutter member 42*c*. The lever 42*a* is held by the shaft 43. The shutter member 42*c* is attached to an end of the lever 42*a* adjacent to the reservoir 19 with a connecting shaft 42*b*. The shutter member 42*c* is moved upward and downward with the rotation of the movement supporting shaft 42*a*, and opens or closes the developer discharge opening 19*b*. The opening and closing of the developer discharge opening 19*b* is accurately performed as the vertical movement of the shutter member 42*c* is guided by a guide member (not shown). The movable member 42 moves counterclockwise due to its own weight and closes the developer discharge opening 19*b*.

The driving member 44 includes a hook section 44*a*, a driver 44*b*, and an unlocking section 44*c*. The hook section 44*a* engages with the joint section 1*c* when the upper body of the copying machine is closed. When the hook section 44*a* engages with the joint section 1*c*, the driver 44*b* pushes down the rear end of the lever 42*a*. As a result, the movable member 42 moves clockwise and opens the developer discharge opening 19*b*. The unlocking section 44*c* is exposed through an opening 1*e* formed in the upper housing member 1*a*. The hook section 44*a* has a guiding surface 44*d*. When the upper body of the copying machine is closed, the guiding surface 44*d* slides over the upper portion of the joint section 1*c* and causes the hook section 44*a* to engage with the locking hole 1*d*.

With this configuration, when the upper body of the copying machine is closed as shown in FIG. 11, the hook section 44*a* engages with the joint section 1*c* as illustrated in FIG. 12. And, the driver 44*b* pushes down the rear end of the lever 42*a*, so that the lever 42*a* moves clockwise. As a result, the shutter member 42*c* is moved upward and the developer discharge opening 19*b* becomes open. In addition, the hook section 44*a* is locked with the joint section 1*c* to prevent the upper body of the copying machine from being opened.

Figure 13:
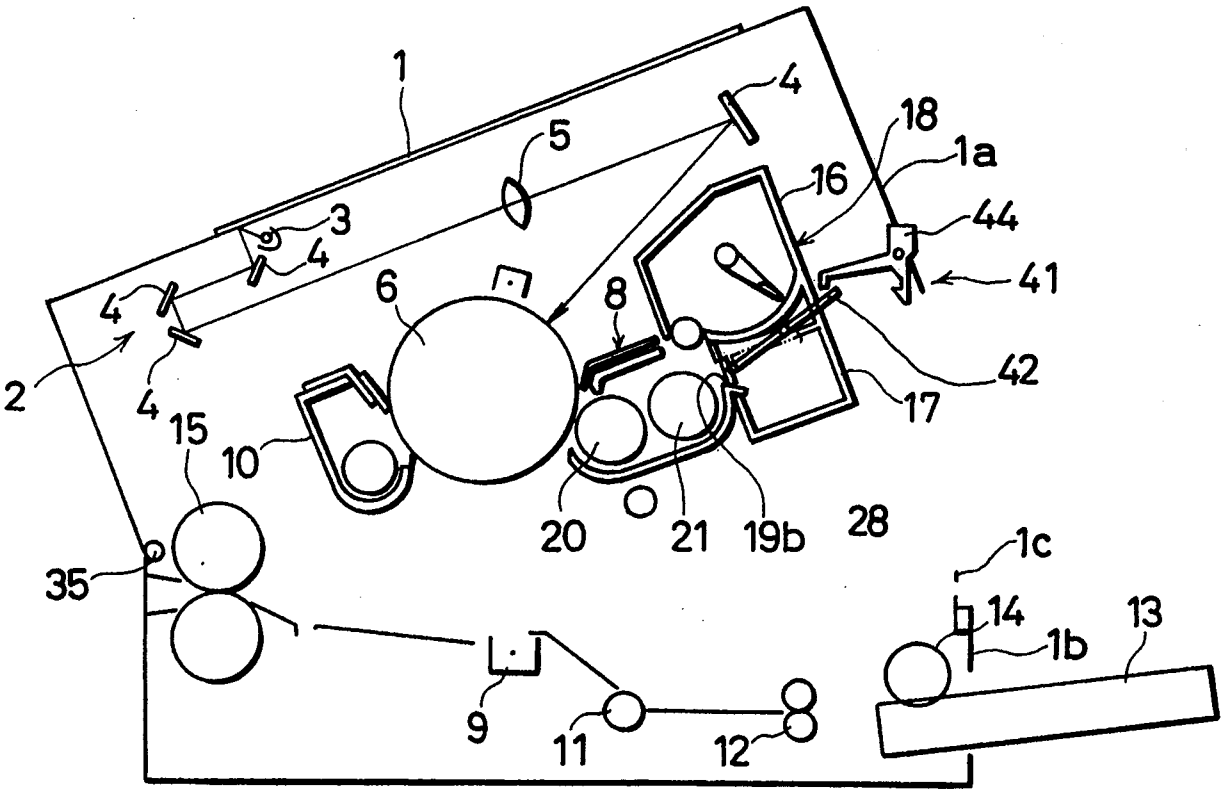
FIG. 13 schematically illustrates an overall structure of the copying machine of FIG. 11, wherein the upper body of the copying machine is opened.
Figure 14:
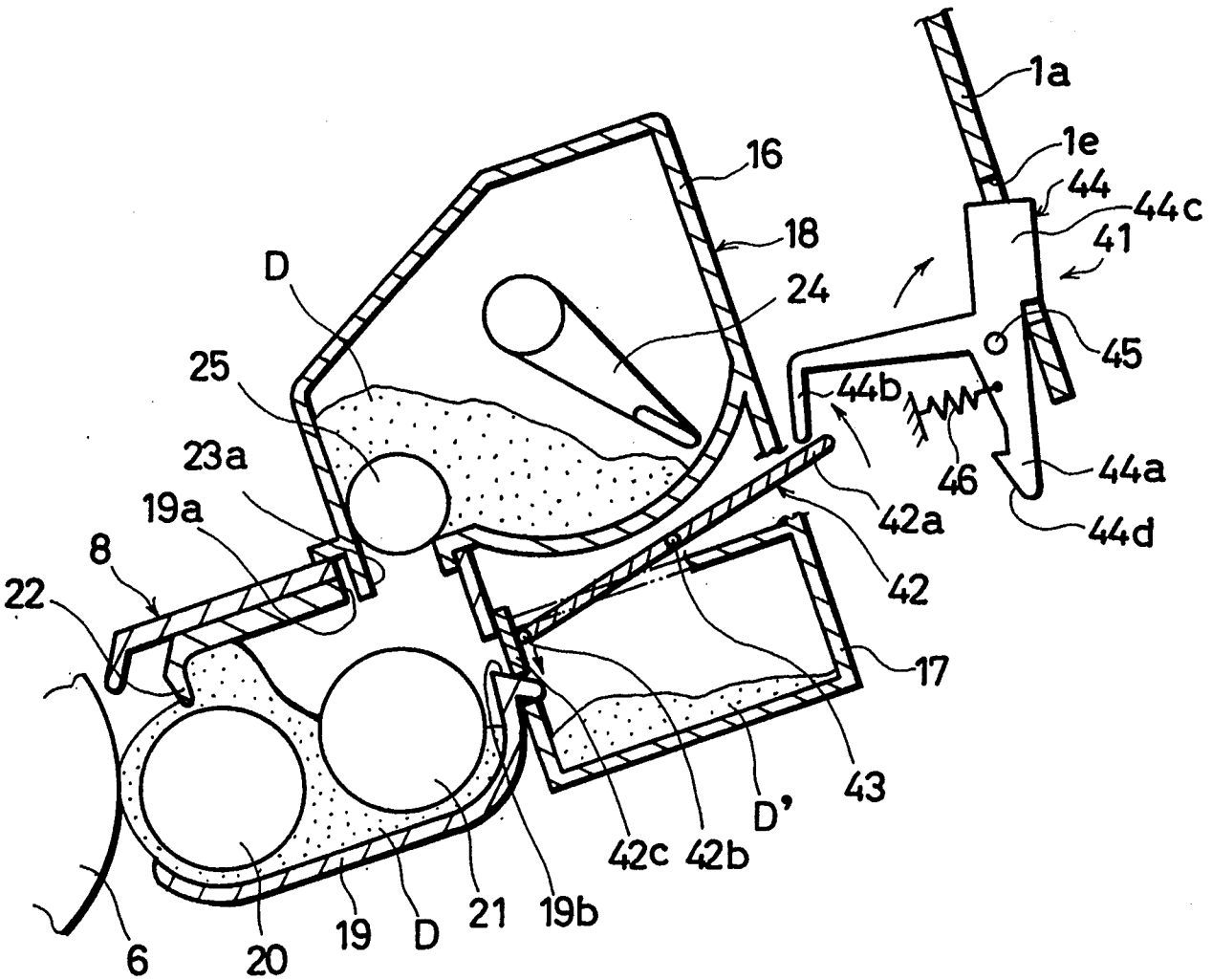
FIG. 14 is a vertical sectional view illustrating how the shutter device operates when the upper body of the copying machine of FIG. 13 is opened.

For instance, when opening the upper body of the copying machine to remove a jammed sheet, the unlocking section 44*c* is pushed inward so as to disengage the hook section 44*a* from the joint section 1*c* as shown by the two-dot chain line of FIG. 12. In this state, when the upper body of the copying machine is lifted, the upper body is opened as shown in FIG. 13. On the other hand, when the hook section 44*a* moves counterclockwise and disengages from the joint section 1*c* in opening the upper body of the copying machine, if the unlocking section 44*c* is stopped being pushed, the driving member 44 is moved clockwise by the force of a tension spring 46 as shown in FIG. 14. This causes the driver 44*b* to come out of contact with the lever 42*a* and the movable member 42 to move counterclockwise due to its own weight. Consequently, the shutter member 42*c* is moved downward, i.e., in a direction to close the developer discharge opening 19*b*.

As described above, in this copying machine, when the upper body is closed, the driving member 44 relating to opening and closing of the developer discharge opening 19*b* locks the upper body with the lower body of the copying machine. Therefore, there is no need to provide a separate locking mechanism.

With the copying machine of this embodiment, like the copying machine of the first embodiment, it is possible to prevent the excessive developer D from being discharged from the developer discharge opening 19*b*. Moreover, the replacement of the unit 18 is performed in either state where the upper body of the copying machine is opened or closed. Furthermore, with this configuration, when transporting the developing device 8 after removing it from the copying machine, the developer D does not spill from the developer discharge opening 19*b*.

In this embodiment, the movable member 42 moves due to its own weight and closes the developer discharge opening 19*b*. However, the movable member 42 may also be designed to move with its own weight in a direction to open the developer discharge opening 19*b*. In this case, the driving member 44 causes the movable member 42 to move in a direction to close the developer discharge opening 19*b* when the upper body of the copying machine is opened. On the other hand, when the driving member 44 does not work the movable member 42, the movable member 42 may be arranged to be moved by the force of a spring instead of its own weight. Moreover, it is also possible to dispose the driving member 44 near the lower housing member 1*b*. In this case, at the time the upper body of the copying machine is opened, the movable member 42 moves due to its own weight or is moved by the force of the spring to a position for closing the developer discharge opening 19*b*. And, when the upper body of the copying machine is closed, the driving member 44 moves the movable member 42 to a position for opening the developer discharge opening 19*b*.

EMBODIMENT 4

The following description discusses a fourth embodiment of the present invention with reference to FIGS. 15 through 20.

The members having the same function as in the above-mentioned embodiment are designated by the same code and their description is omitted.

Figure 15:
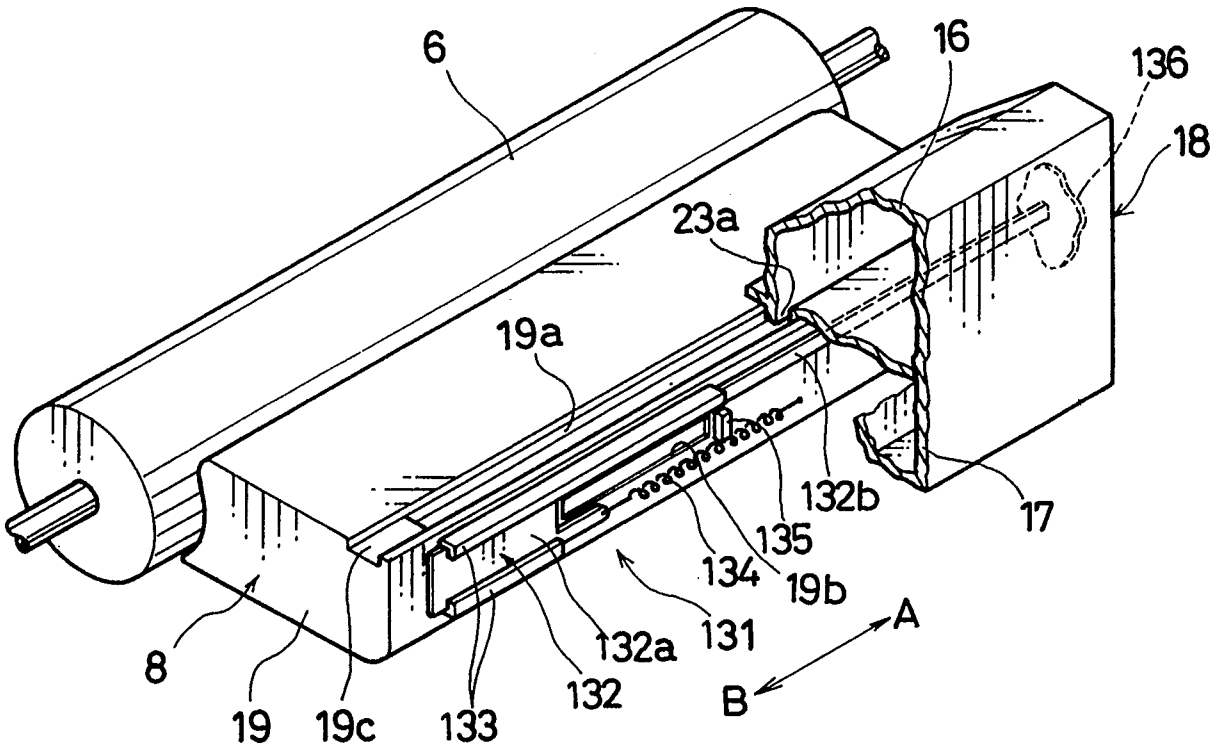
FIG. 15 is a perspective view of a fourth embodiment of the present invention, illustrating the shutter device in a developing device by sectionally showing the unit.
Figure 16:
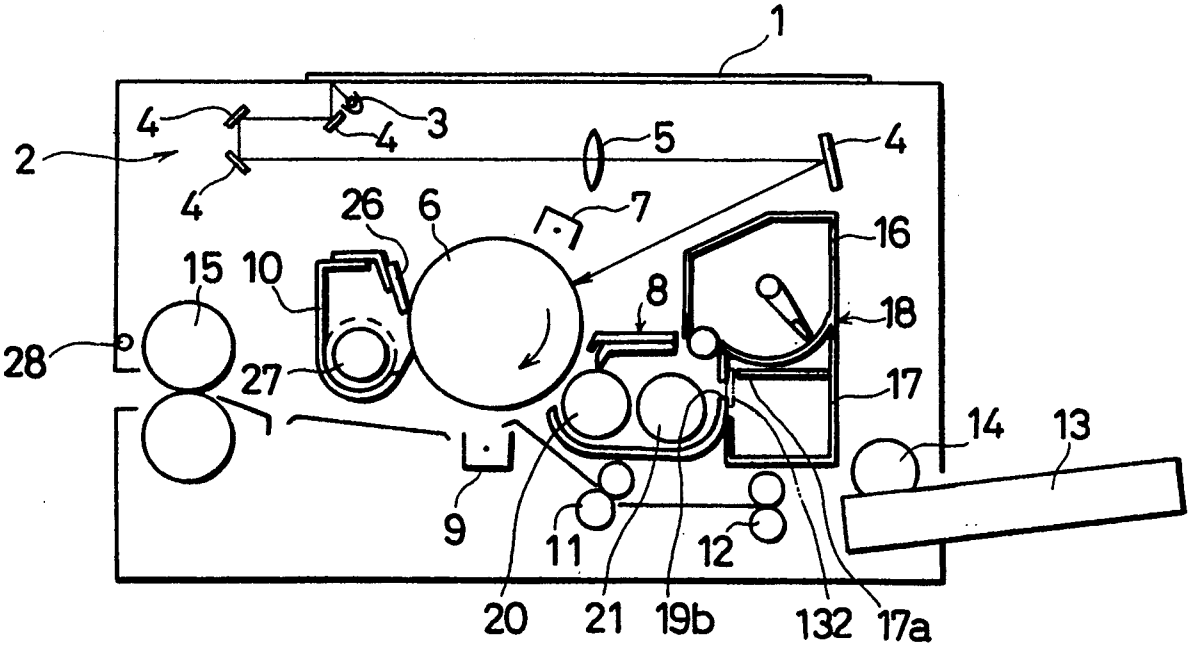
FIG. 16 schematically illustrates an overall structure of a copying machine including the developing device.
Figure 17:
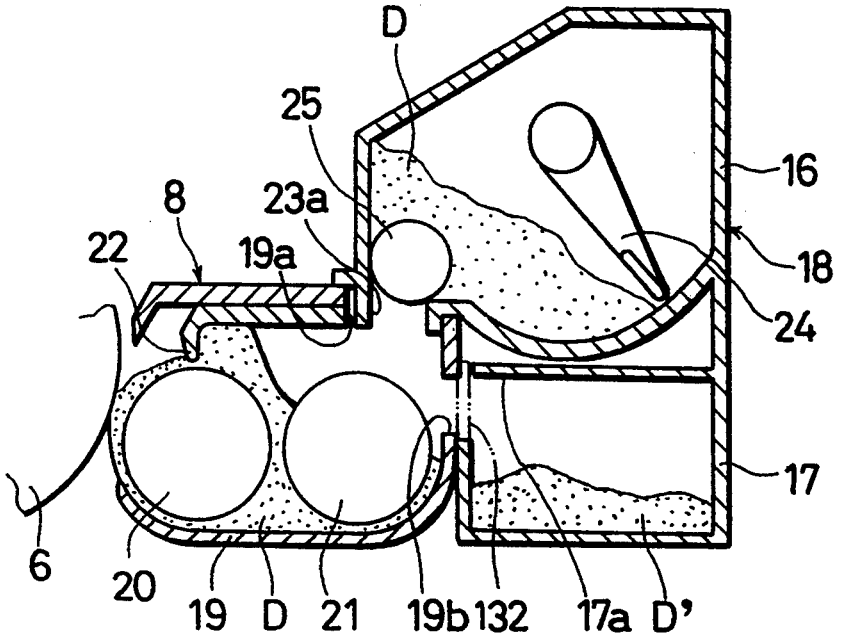
FIG. 17 is an enlarged vertical sectional view illustrating the developing device and the unit shown in FIG. 16.

As illustrated in FIG. 15, the developing device 8 according to this embodiment has a shutter device 131 for opening and closing the developer discharge opening 19*b*. *The shutter device 131 includes:*

(1) a shutter member 132 for opening and closing the developer discharge opening 19*b;*
(2) upper and lower guide members 133 for guiding the shutter member 132 to be moved in the A-B direction shown in FIG. 15;
(3) a tension spring 134 for pulling the shutter member 132 in the direction of arrow A to close the developer discharge opening 19*b;*
(4) a stopper 135 for stopping the shutter member 132 at a position where the developer discharge opening is closed; and
(5) a stop plate 136 attached to the rear end of the shutter member 132 when viewed from the front of the copying machine.

According to this embodiment, when installing the developing device 8 in a copying machine, the developing device 8 is moved in the direction of arrow A. On the other hand, when removing the developing device 8 from the copying machine, it is moved in the direction of arrow B. In the case where the photoreceptor 6 is cylindrical in shape, the A-B direction is parallel to the central axis of the photoreceptor 6.

Figure 19:
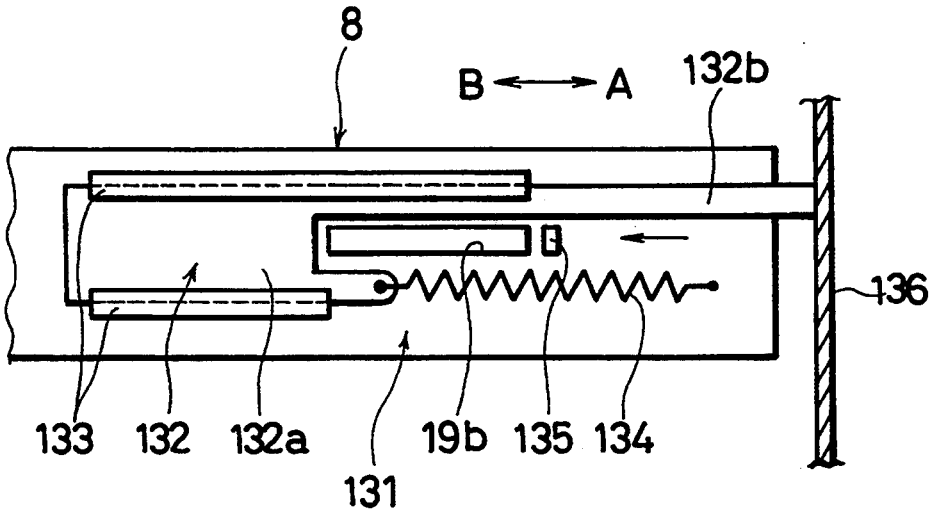
FIG. 19 is an explanatory view illustrating how the shutter device of FIG. 15 operates when the developing device is installed in the copying machine.

The shutter member 132 includes a cover section 132*a* for opening and closing the developer discharge opening 19*b* and an extension section 132*b* extending from the cover section 132*a* toward the direction of arrow A. As illustrated in FIG. 19, when installing the developing device 8 in the copying machine, the end of the extension section 132*b* comes into contact with the stop plate 136 and causes the shutter member 132*a* to be moved in the direction of arrow B to open the developer discharge opening 19*b*.

The stop plate 136 is constituted by some wall member in the copying machine. It is also possible to form the extension section 132*b* and the cover section 132*a* separately and design the extension section 132*b* to extend in the direction of arrow B from the stop plate 136.

Figure 18:
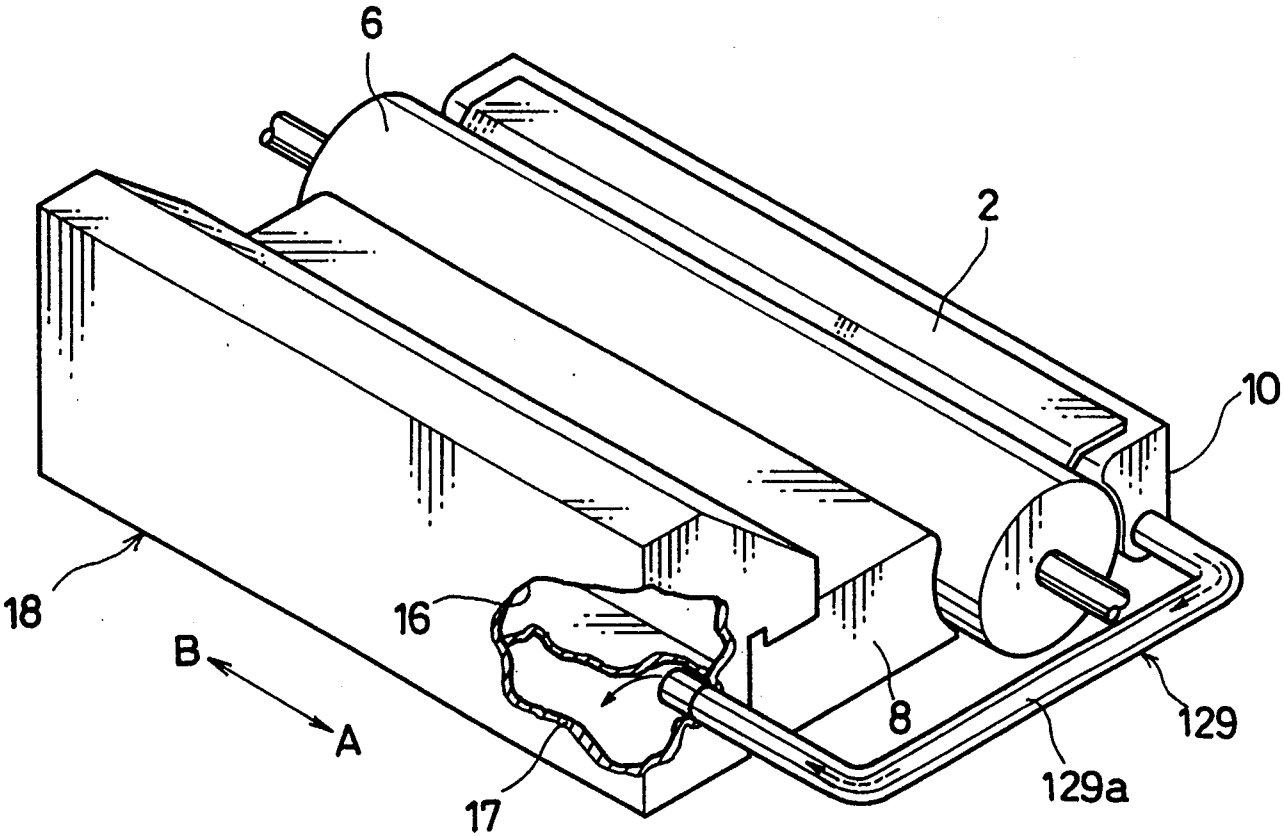
FIG. 18 is a perspective view illustrating the cleaning device and the developer transport device disposed near the rear end of the unit of FIG. 16.

As illustrated in FIG. 18, the cleaning device 10 is connected to the waste container 17 through a developer transporting device 129. The transport screw 27 (see FIG. 16) in the cleaning device 10 sends into the developer transporting device 129 used toner scraped off from the surface of the photoreceptor 6. The developer transporting device 129 includes, for example, a transport tube 129*a* having therein a transport screw for transporting the used toner into the waste container 17. The waste container 17 is freely attached to and detached from the transport tube 129*a*.

With this configuration, when the waste container 17 is filled up with the waste developer D', the unit 18 is removed from the developing device 8 to throw out the waste developer D' in the waste container 17. At this time, when the unit 18 is pulled in the direction of arrow B, the waste container 17 is disconnected from the developer transporting device 129, thereby enabling the unit 18 to be removed. Installation of the unit 18 is performed through the reverse process. The unit 18 may be used again or replaced.

Figure 20:
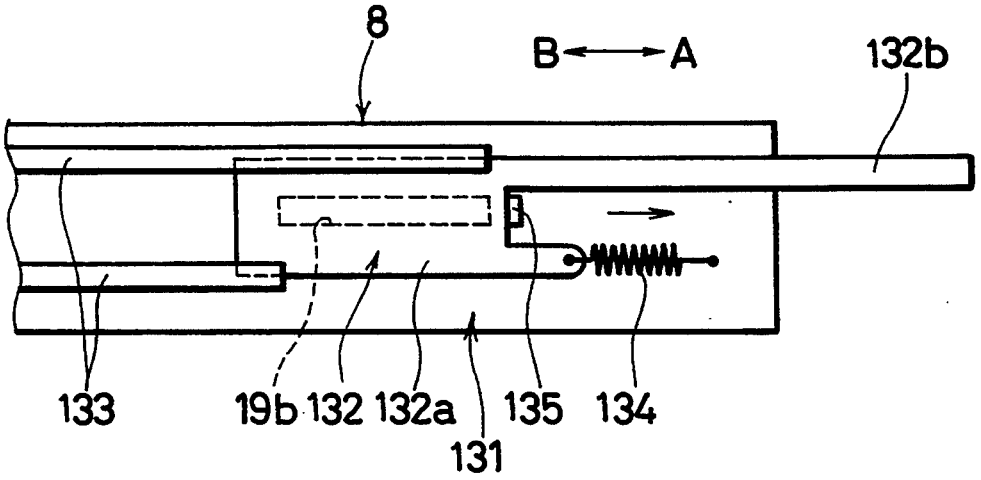
FIG. 20 is an explanatory view illustrating how the shutter device of FIG. 15 operates when the developing device is removed from the copying machine.

For example, when removing the developing device 8 from the copying machine to replace the developing device 8, the unit 18 is removed in the above-mentioned manner and the developing device 8 is then pulled in the direction of arrow B. When the developing device 8 is pulled out, the shutter member 132 which is pulled by the tension spring 134 is moved in the direction of arrow A in the shutter device 131. When the developing device 8 is further pulled, the extension section 132*b* comes out of contact with the stop plate 136. As a result, as shown in FIG. 20, the developer discharge opening 19*b* is fully covered with the cover section 132*a*. At this time, the stopper 135 stops the shutter member 132 at the position where the developer discharge opening 19*b* is closed.

Meanwhile, when the developing device 8 is installed in the copying machine through the reverse process, the extension section 132*b* comes into contact with the stop plate 136 as shown in FIG. 19. This causes the cover section 132*a* to be moved in the direction of arrow B, thereby opening the developer discharge opening 19*b*.

As described above, in this copying machine, the used toner collected by the cleaning device 10 is transported to the waste container 17 by the developer transporting device 129, the replacement of the cleaning device 10 and of the waste container 17 and discarding the developer are performed at the same time. Namely, only when the waste container 17 becomes full, replacing the waste container 17 is required. Thus, the developer is easily handled and maintained.

In addition, since the used toner is not stored in the cleaning device 10, it is possible to make the cleaning device 10 smaller. On the contrary, there is a need to build the larger waste container 17. Although the cleaning device 10 is needed to be disposed in a crowded space around the photoreceptor 6 where the various means are disposed, the waste container 17 is disposed in any suitable space in the copying machine. It is therefore possible to give a smaller copying machine by decreasing the size of the cleaning device 10.

In the case where the cleaning device 10 and the photoreceptor 6 are integrated into a cartridge, the replacement of the cartridge is performed in accordance with the degree of the deterioration of the photoreceptor 6. In the case when the cartridge does not have the developer transporting device 129, the life of the cartridge varies depending not on the degree of the deterioration of the photoreceptor 6 but on the capacity of the cleaning device 10 for storing the used toner. Namely, even when the photoreceptor 6 is still usable, there is a possibility that the replacement of the cartridge is required. On the other hand, the structure of the copying machine of this embodiment overcomes such a drawback.

The shutter device 131 opens and closes the developer discharge opening 19*b* when the developing device 8 is installed in and removed from the copying machine. It is thus possible to prevent the developer D from spilling from the developer discharge opening 19*b* due to the impact of installing or removing the developing device 8 and a tilt of the developing device 8 caused when transported. Consequently, there is no need to worry about spilling of the developer D from the developing device 8 during installation, removal and transportation of the developing device 8. As a result, a copying machine achieving easy handling of developer is obtained.

EMBODIMENT 5

The following description discusses a fifth embodiment of the present invention with reference to FIGS. 21 through 25. The members having the same function as in the above-mentioned embodiment are designated by the same code and their description is omitted.

A copying machine according to this embodiment has a shutter device 141 for opening and closing the developer discharge opening 19*b* as illustrated in FIG.

Figure 22:
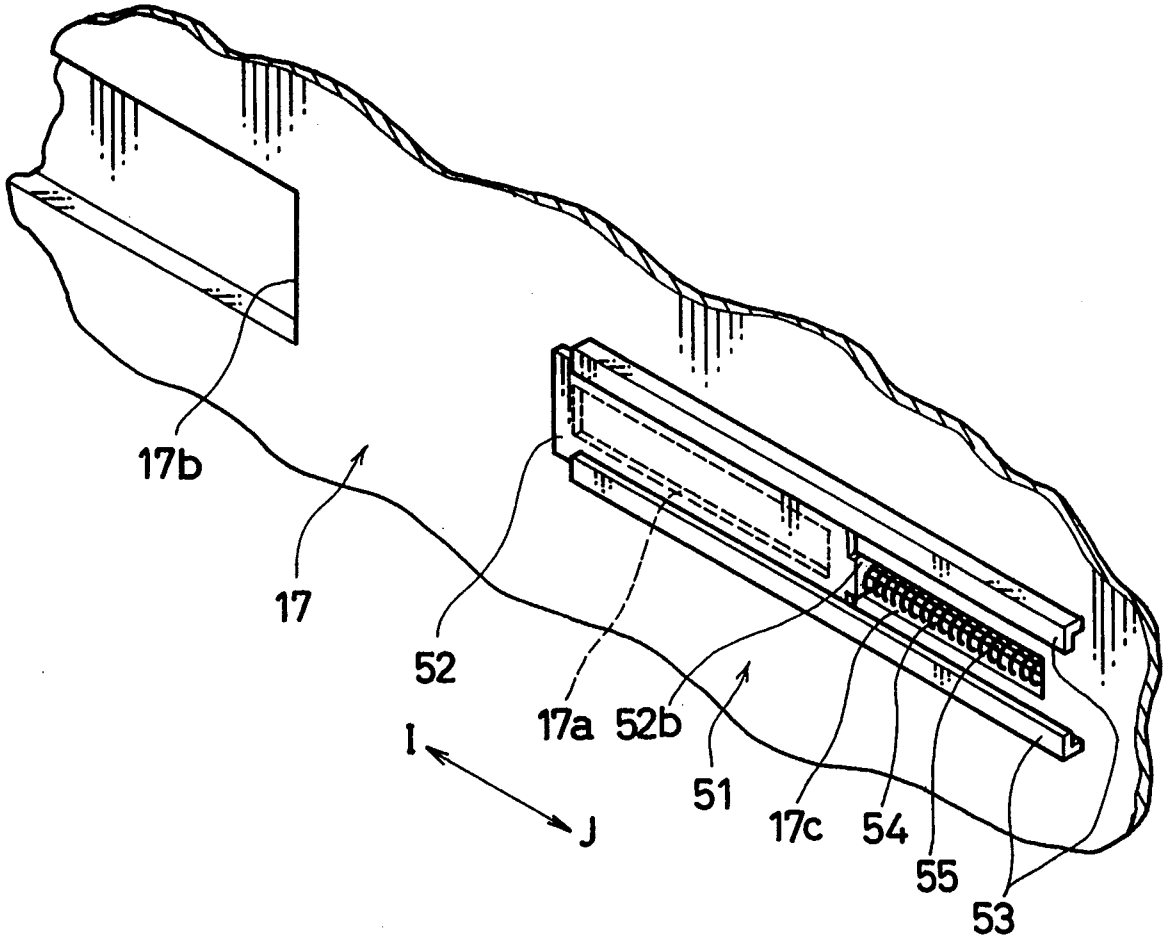
FIG. 22 is a perspective view illustrating essential part of a shutter device which is installed in the waste container and interacts with the shutter device in the developing device.

21, and a shutter device 51 for opening and closing the developer collecting opening 17*a* of the waste container 17 as shown in FIG. 22.

Figure 21:
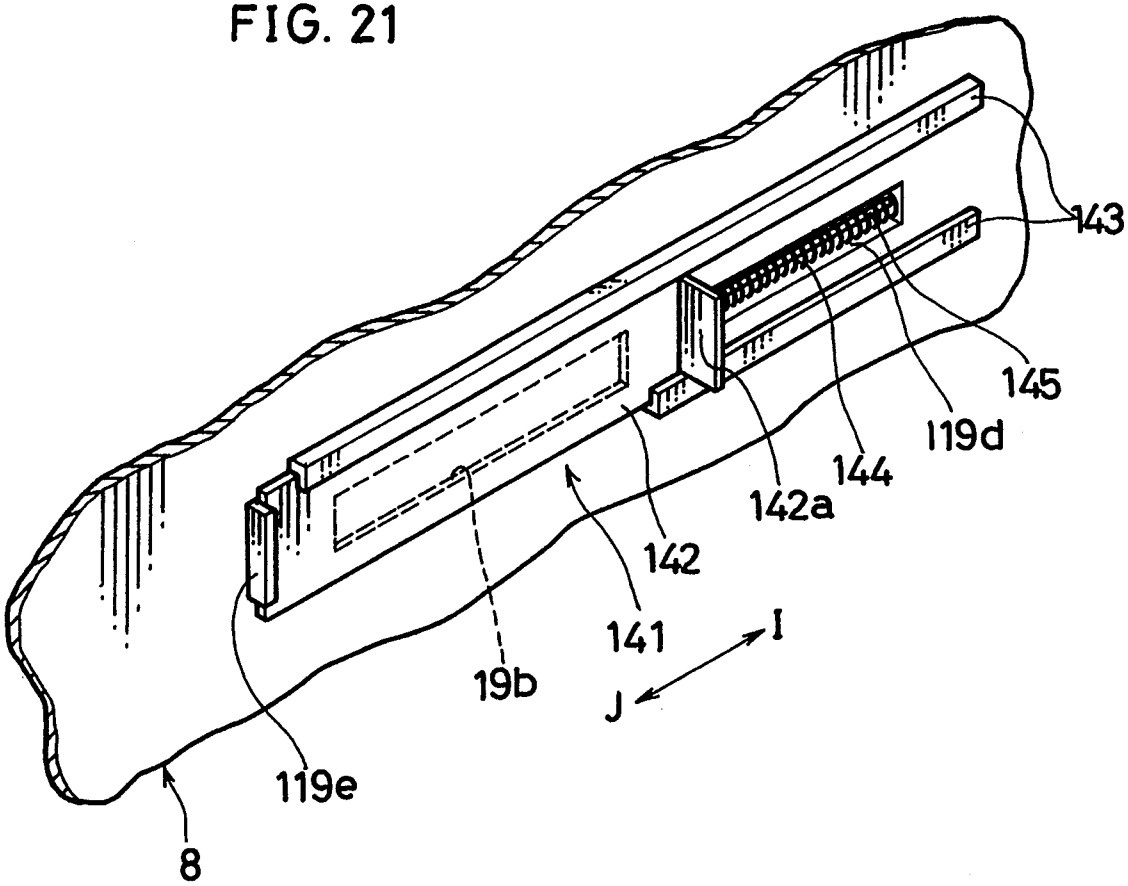
FIG. 21 is a perspective view of a fifth embodiment of the present invention, illustrating essential part of a shutter device installed in the developing device.
Figure 23:
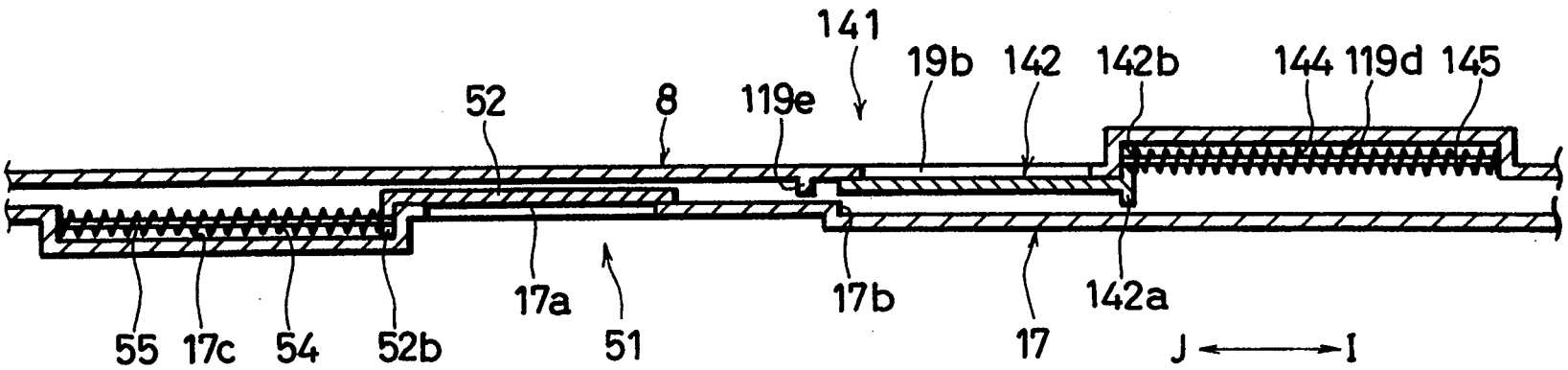
FIG. 23 is a transverse sectional view illustrating the shutter device in the developing device and the shutter device in the waste container when starting the installation of the waste container in the developing device.

The shutter device 141 includes:

(1) a shutter member 142;

(2) upper and lower guide members 143 for guiding the shutter member 142 to be moved in the I-J direction shown in FIG. 21;

(3) a slot 119*d* formed in the reservoir 19;

(4) a compression spring 144, mounted in the slot 119*d*, for pushing the shutter member 142 in the direction of arrow J to close the developer discharge opening 19*b*; and (5) a guide shaft 145 for holding the compression spring 11 within the slot 119*d*; and (6) a step-like contact section 17*b* formed in a wall surface of the waste container 17 adjacent to the developing device 8 as shown in FIGS. 22 and 23 (the contact section 17*b* being located some distant from the rear end of the developer collecting opening 17*a*).

When installing the unit 18 of this embodiment in the developing device 8, the unit 18 is moved in the direction of arrow I. On the other hand, when removing the unit 18 from the developing device 8, it is moved in the direction of arrow J.

As illustrated in FIGS. 21 and 23, the shutter member 142 includes a guided section 142*a* protruding toward the waste container 17 and a guided section 142*b* protruding into the slot 119*d*. When installing the unit 18 in the developing device 8, it is moved in the direction of arrow I and the contact section 17*b* comes into contact with the guided section 142*a*.

The guide shaft 145 penetrates the guided section 142*b*. When the guided section 142*b* is pushed by the compression spring 144, the shutter member 142 is moved in the direction of arrow J to close the developer discharge opening 19*b*. The movement of the shutter member 142 in the direction of arrow J is restricted as the guided section 142 comes into contact with an end of the slot 119*d* adjacent to the developer discharge opening 19*b*.

As illustrated in FIG. 22, the shutter device 51 includes:

(1) a shutter member 52;

(2) upper and lower guide members 53 for guiding the shutter member 52 to be moved in the directions of arrow I and J;

(3) a slot 17*c* formed in the waste container 17;

(4) a compression spring 54, disposed in the slot 17*c*, for applying to the shutter member 52 a force in the direction of arrow I to close the developer collecting opening 17*a*;

(5) a guide shaft 55 for holding the compression spring 54 in the slot 17*c*; and (6) a protruding connecting section 119*e* formed on a wall surface of the reservoir 19 adjacent to the waste container 17 (the connecting section 119*e* is located on one side of the developer discharge opening 19*b* where the slot 119*e* is not formed and some distant therefrom).

As illustrated in FIGS. 22 and 23, one of the ends of the shutter member 52 further from the contact section 17*b* extends into the slot 17*c* and forms a guided section 52*b*. The guide shaft 55 passes through the guided section 52*b*. When the guided section 52*b* is pushed by the compression spring 54, the shutter member 52 is moved in the direction of I to close the developer collecting opening 17*a*. The movement of the shutter member 52 in the direction of arrow I is restricted as the guided section 52*b* comes into contact with one end of the slot 17*c* which is closer to the contact section 17*b*. On the other hand, when the unit 18 is moved in the direction of arrow I for installation, the other end of the shutter member 52 comes into contact with the connecting section 119*e*.

Figure 24:
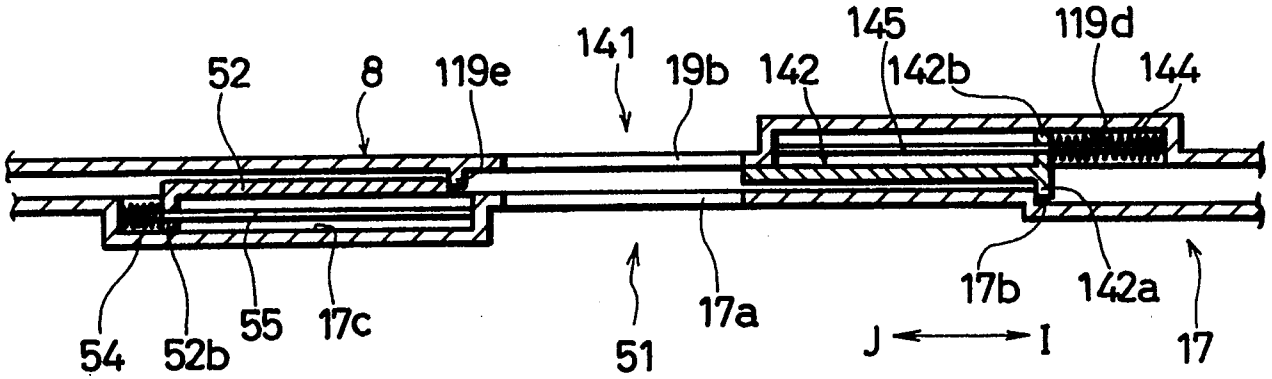
FIG. 24 is a transverse sectional view illustrating the shutter device in the developing device and the shutter device in the waste container when the waste container is completely installed in the developing device.
Figure 25:
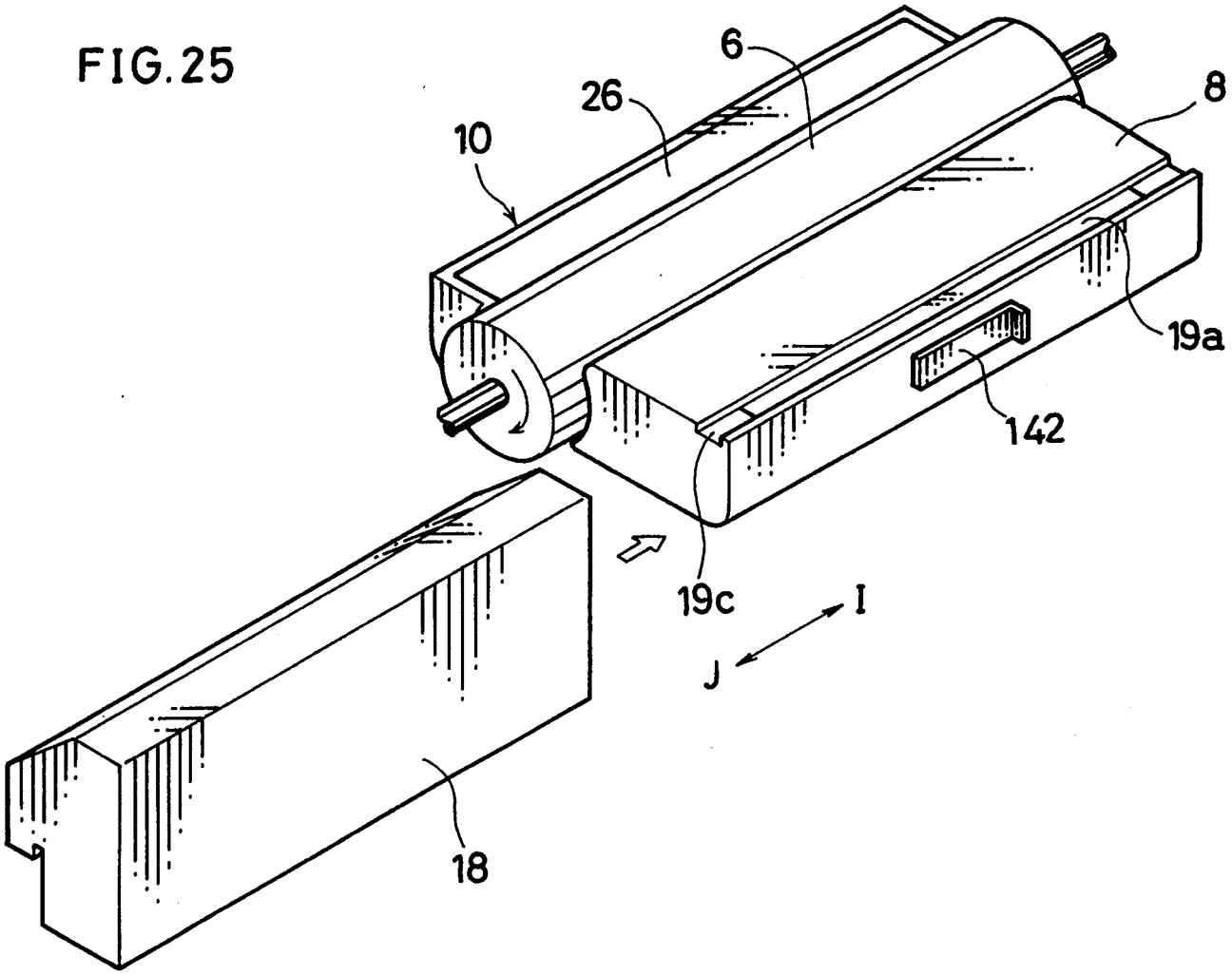
FIG. 25 is a perspective view schematically illustrating how the waste container is installed in the developing device.

According to this configuration, when installing the unit 18 in the developing device 8, as shown in FIG. 25, the unit 18 is caused to fit into the grooved section 19*c* of the developing device 8 and then pushed in the direction of arrow I. FIG. 23 shows a state where the installation of the unit 18 is just started. When the unit 18 is further pushed in the direction of arrow I, the contact section 17*b* comes into contact with the guided section 142*a*. This causes the connecting section 119*e* to engage with the end of the shutter member 52. Thus, as the unit 18 is moved in the direction of arrow I, the shutter members 142 and 52 uncover the developer discharge opening 19*b* and the developer collecting opening 17*a*, respectively. When the installation of the unit 18 is complete, the developer discharge opening 19*b* and the developer collecting opening 17*a* become fully open at the same position as shown in FIG. 24. Consequently, the developer D is discharged into the waste container 17 from the developing device 8 through the developer discharge opening 19*b* and the developer collecting opening 17*a*.

Meanwhile, the removal of the unit 18 from the developing device 8 is carried out through the reverse process. As the unit 18 is moved in the direction of arrow J, the shutter member 142 is moved in the direction of arrow J and the shutter member 52 is moved in the direction of arrow I. When the removal of the unit 18 is complete, the developer discharge opening 19*b* and the developer collecting opening 17*a* are fully covered.

As described above, the copying machine has the shutter devices 141 and 51 which open and close the developer discharge opening 19*b* and the developer collecting opening 17*a*, respectively, by simply attaching or detaching the unit 18 to/from the developing device 8. This configuration prevents the developer D from spilling from the developer discharge opening 19*b* or the developer collecting opening 17*a* on the impact of removing the unit 18 from the developing device 8 or of removing the developing device 8 from the copying machine, or by a tilt caused when transporting the removed developing device 8 and the unit 18. Thus, no special care is required when removing or transporting the unit 18 and the developing device 8. As a result, a copying machine enabling easier handling of the developer is obtained.

The copying machine according to this embodiment includes both the shutter device 141 and the shutter device 51. However, when only the developer discharge opening 19*b* is needed to be uncovered and covered by installing and removing the waste container 17 in/from the developing machine 8, the shutter device 141 is solely provided.

EMBODIMENT 6

The following description discusses a sixth embodiment of the present invention with reference to FIGS. 26 through 33.

The members having the same function as in the above-mentioned embodiment are designated by the same code and their description is omitted.

Figure 26:
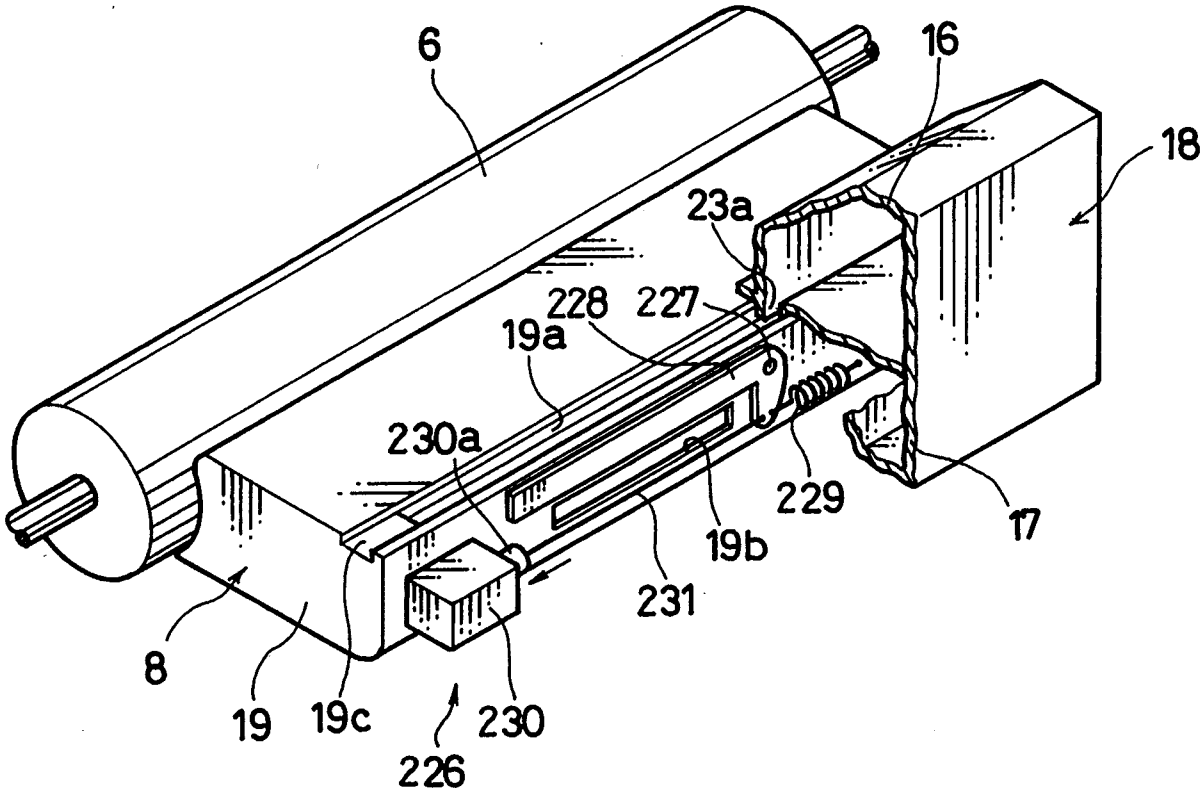
FIG. 26 is a perspective view of a sixth embodiment of the present invention, illustrating the shutter device in the developing device by sectionally showing the unit.

As illustrated in FIG. 26, the developing device 8 according to this embodiment has a shutter device 226 for opening and closing the developer discharge opening 19*b*. *The shutter device 226 includes:*

(1) a shutter member 228 attached pivotally on a shaft 227 above the developer discharge opening 19*b;*
(2) a tension spring 229 which pulls the shutter member 228 so that the shutter member 228 pivots in a direction to close the developer discharge opening 19*b;*
(3) a solenoid 230 having a rod 230*a* which is retracted when the solenoid 230 is turned ON; and
(4) a wire 231 which connects the shutter member 228 and the rod 230*a* so that the shutter member 228 pivots in a direction to open the developer .discharge opening 19*b* when the rod 230*a* is retracted.

Like the fourth embodiment, the cleaning device 10 according to this embodiment includes the developer transporting device for transporting into the waste container 17 the used toner scraped off from the surface of the photoreceptor 6.

Figure 27:
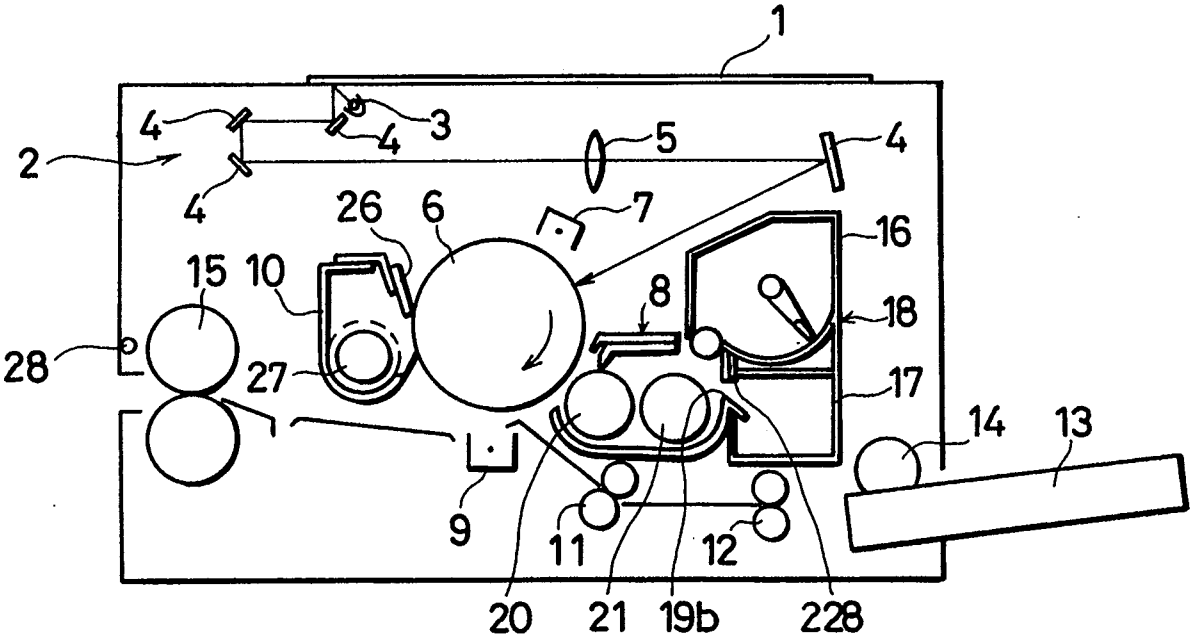
FIG. 27 schematically illustrates an overall structure of a copying machine including the shutter device of FIG. 26.
Figure 28:
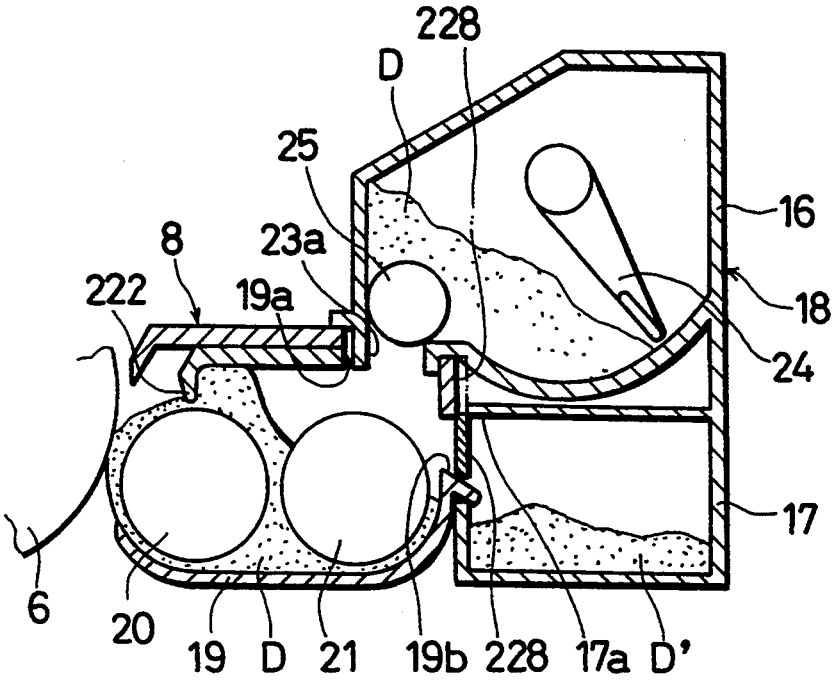
FIG. 28 is an enlarged vertical sectional view illustrating the developing device and the unit shown in FIG. 27.
Figure 29:
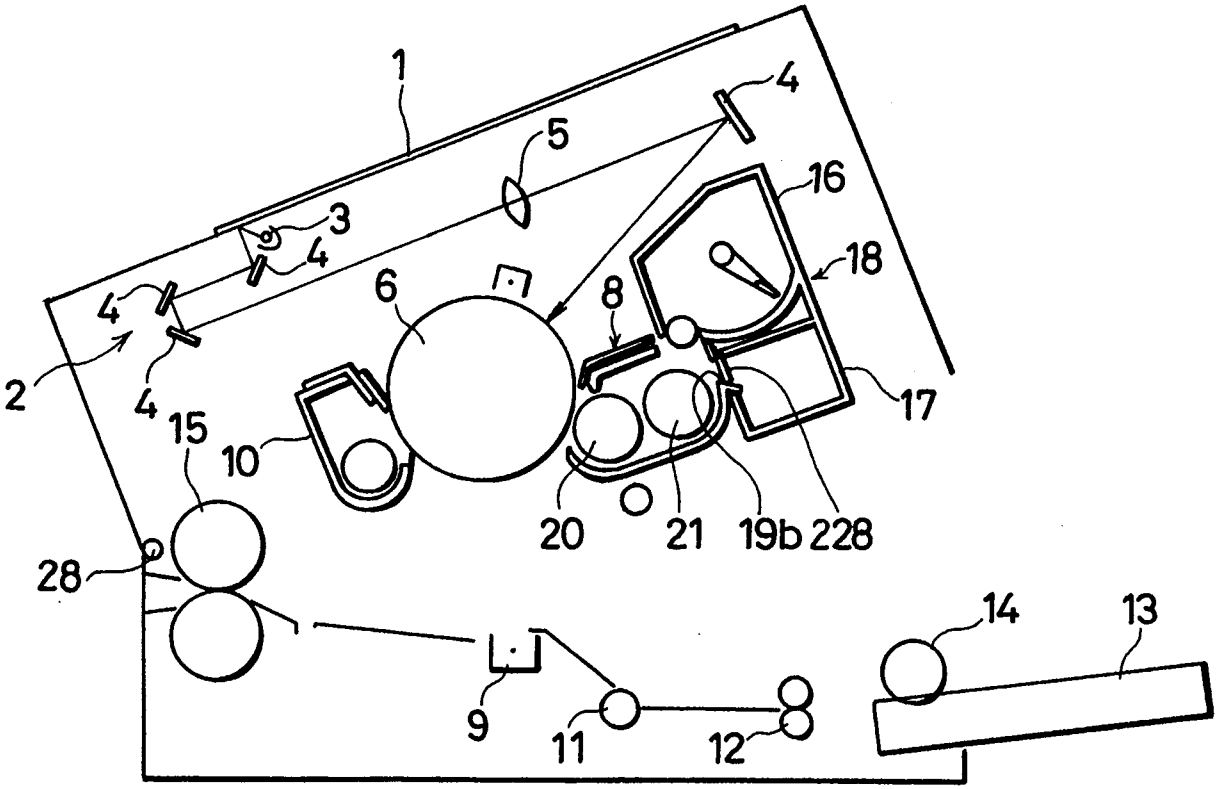
FIG. 29 schematically illustrates an overall structure of the copying machine of FIG. 27, wherein the upper body of the copying machine is opened.
Figure 30:
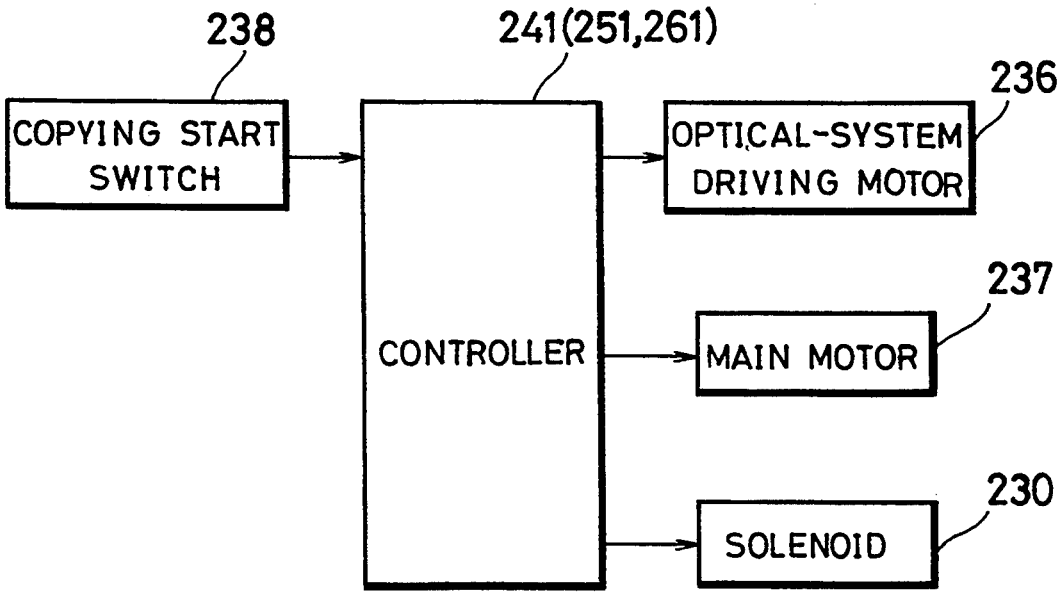
FIG. 30 is a block diagram illustrating essential part of a control system in the copying machine of FIG. 27.

In the copying machine shown in FIG. 27, the optical system 2 for scanning the document is driven by an optical-system driving motor 236 shown in FIG. 30. Means other than the optical system 2, such as the photoreceptor 6, the developing device 8, the unit 18 and the sheet transporting system are driven by a main motor 237.

A controller 241 controls actuating the optical-system driving motor 236, the main motor 237 and the solenoid 230 according to an instruction to start a copying operation given, for example, through a copying start switch 238. The controller 241 is constituted by a microcomputer, and its operation is described hereinafter.

Figure 31:
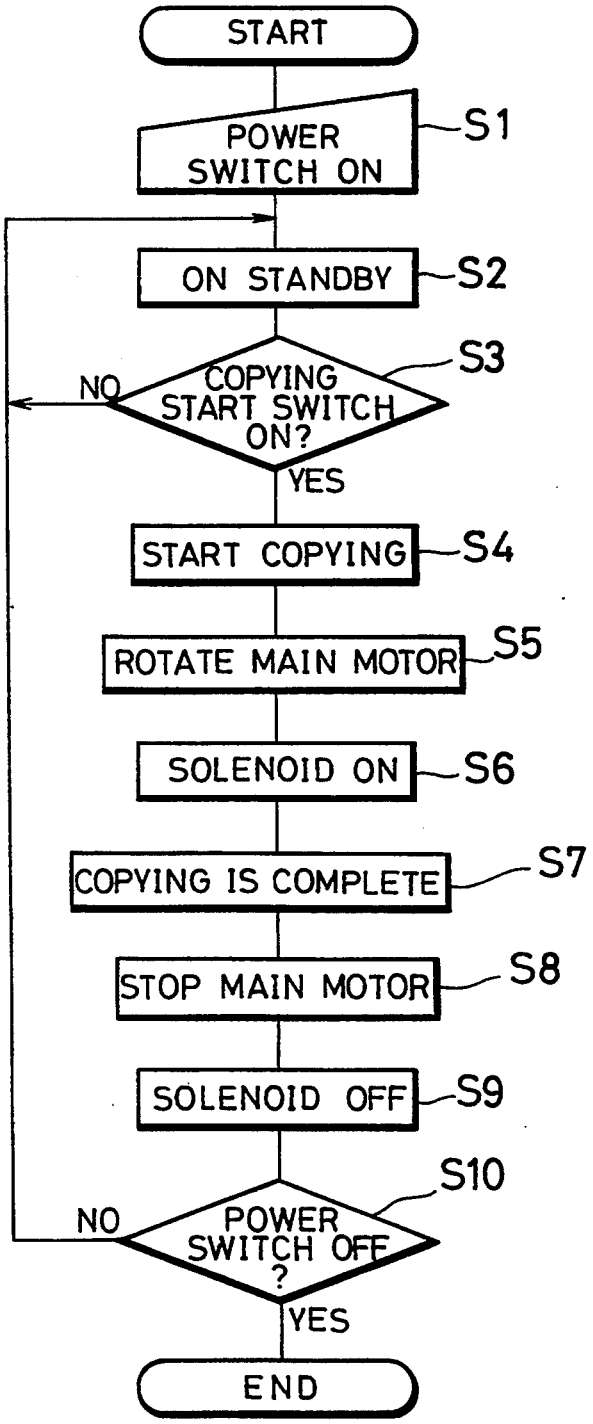
FIG. 31 is a flow chart illustrating how the control device of FIG. 30 controls the shutter device.

With this configuration, how the controller 241 controls the shutter device 226 is explained with reference to the flow chart of FIG. 31.

Figure 32:
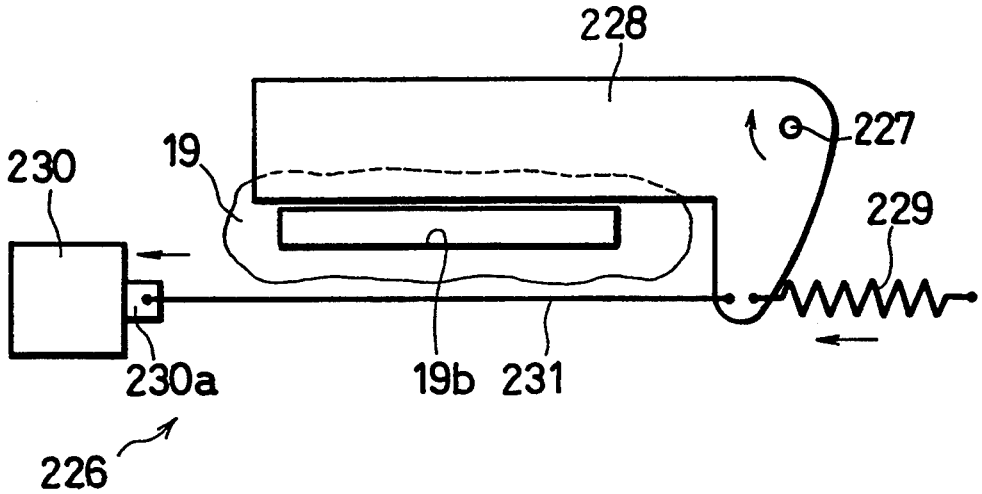
FIG. 32 is an explanatory view illustrating how the shutter device of FIG. 26 opens a developer discharge opening.

When the power switch is turned ON (step 1, hereinafter indicated as S1), the copying machine becomes on standby (S2). In this state, when the copying start switch 238 is turned ON (S3), a copying operation is started (S4). At this time, the main motor 237 starts rotating (S5) and the solenoid 230 of the shutter device 226 is turned ON (S6). This causes the rod 230 to be retracted as shown in FIG. 32 and the shutter member 228 to be pulled by the wire 231 so that the shutter member 228 pivots clockwise against the force of the tension spring 229 and opens the developer discharge opening 19*b*. As a result, the developer discharge opening 19*b* is connected to the developer collecting opening 17*a*, and the developer D becomes ready to be discharged from the developing device 8 by overflow.

Figure 33:
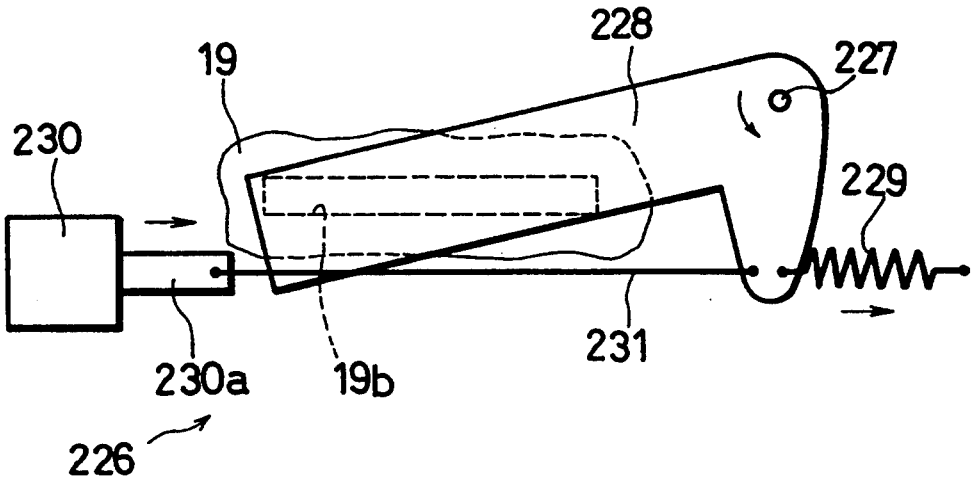
FIG. 33 is an explanatory view illustrating how the shutter device of FIG. 26 closes the developer discharge opening.

When the copying operation is complete (S7), the main motor 237 is stopped (S8) and the solenoid 230 is turned OFF (S9). Consequently, the solenoid 230 stops pulling, and the shutter member 228 is pulled by the tension spring 229. As a result, the shutter member 228 pivots in the reverse direction to close the developer discharge opening 19*b* as shown in FIG. 33. At this time, the rod 230*a* is pulled and moved forward by a maximum amount with the wire 231. Subsequently, the power switch is turned OFF (S10) and a series of operation is complete.

As described above, in this copying machine, the shutter member 228 opens the developer discharge opening 19*b* in synchronism with the rotation of the main motor 237, while it closes the developer discharge opening 19*b* as the motor 237 is stopped. Therefore, in the state where the main motor 237 is stopped, even if the copying machine is moved or if the upper body of the copying machine is moved round the supporting point 28 to remove a jammed sheet and causes an impact on the developing device 8, the excessive developer D is not discharged from the developer discharge opening 19*b*.

In this embodiment, the developer discharge opening 19*b* becomes open or closed in synchronism with the motion of the main motor 237. Opening and closing the developer discharge opening 19*b* may also be carried out in synchronism with, at least, the motion of a motor which drives the developing device 8.

EMBODIMENT 7

The following description discusses a seventh embodiment of the present invention with reference to FIGS. 30 through 34.

Figure 34:
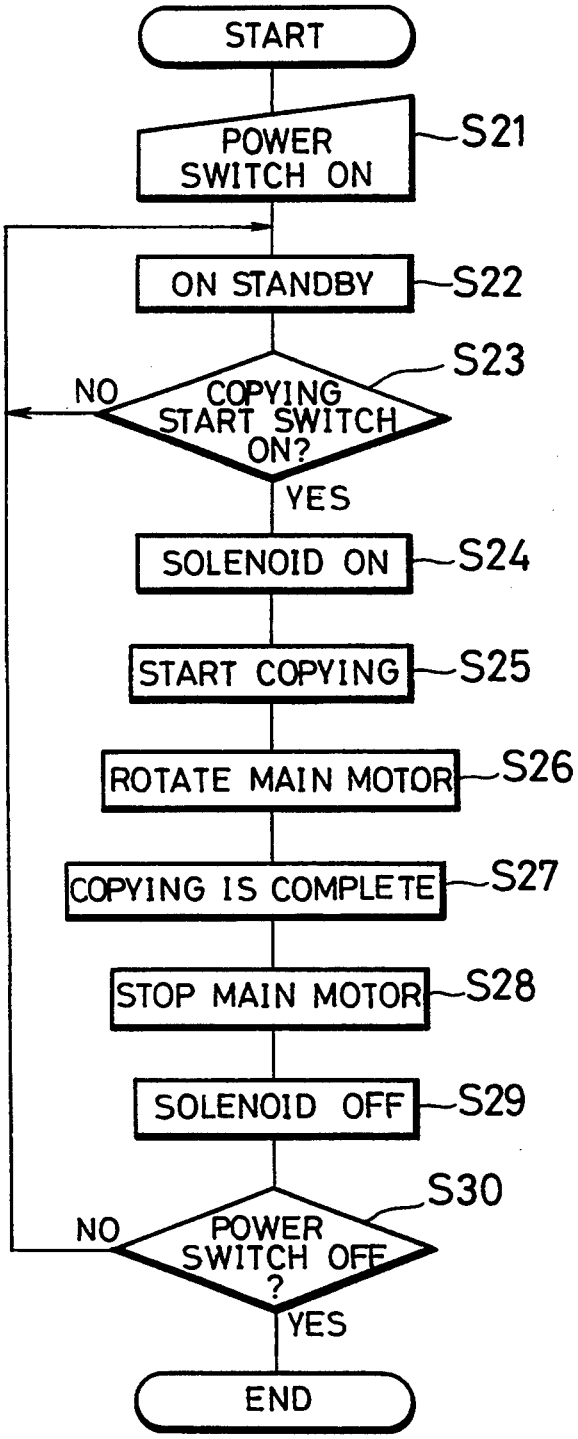
FIG. 34 is a flow chart illustrating how the shutter device is controlled according to a seventh embodiment of the present invention.

A copying machine according to this embodiment includes a controller 251 instead of the controller 241 shown in FIG. 30. The controller 251 controls the shutter device 226 as illustrated in FIG. 34. Except for the control of the shutter device 226, the copying machine of this embodiment has the same structure as that of the sixth embodiment.

In this copying machine, as illustrated in FIG. 34, the controller 251 controls the shutter device 226 so that, when the copying start switch 238 is turned ON (S23), the solenoid 230 is turned ON (S24) and the developer discharge opening 19*b* becomes open. When the copying operation is complete (S27), the main motor 237 is stopped (S28), the solenoid 230 is turned OFF (S29) and the developer discharge opening 19*b* is covered.

This arrangement prevents the excessive developer D from being discharged from the developer discharge opening 19*b* due to the impact on the developing device 8 caused when the main motor 237 is stopped. The developer discharge opening 19*b* is covered at the time at least a motor driving the developing device 8 among the motors including the main motor 237 is stopped.

EMBODIMENT 8

The following description discusses an eighth embodiment of the present invention with reference to FIGS. 30, and 35 through 38.

Figure 35:
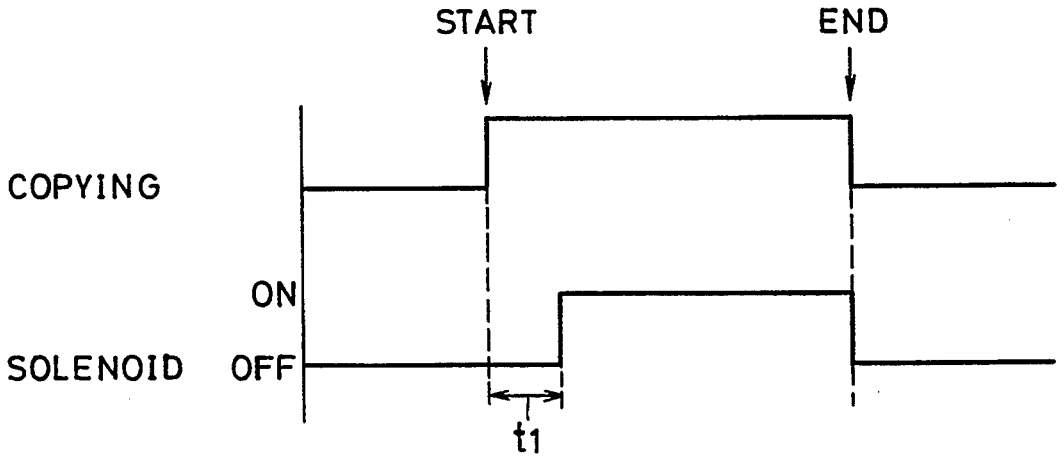
FIG. 35 is a timing chart of an eighth embodiment of the present invention, showing the relation between a copying operation and the actuation of the solenoid of the shutter device.

A copying machine according to this embodiment includes a controller 261 instead of the controller 241 shown in FIG. 30. The controller 261 includes therein a timer for measuring time, and controls the shutter device 226 as illustrated in FIG. 35. Except for such changes, the copying machine of this embodiment has the same structure as that of the sixth embodiment.

Figure 36:
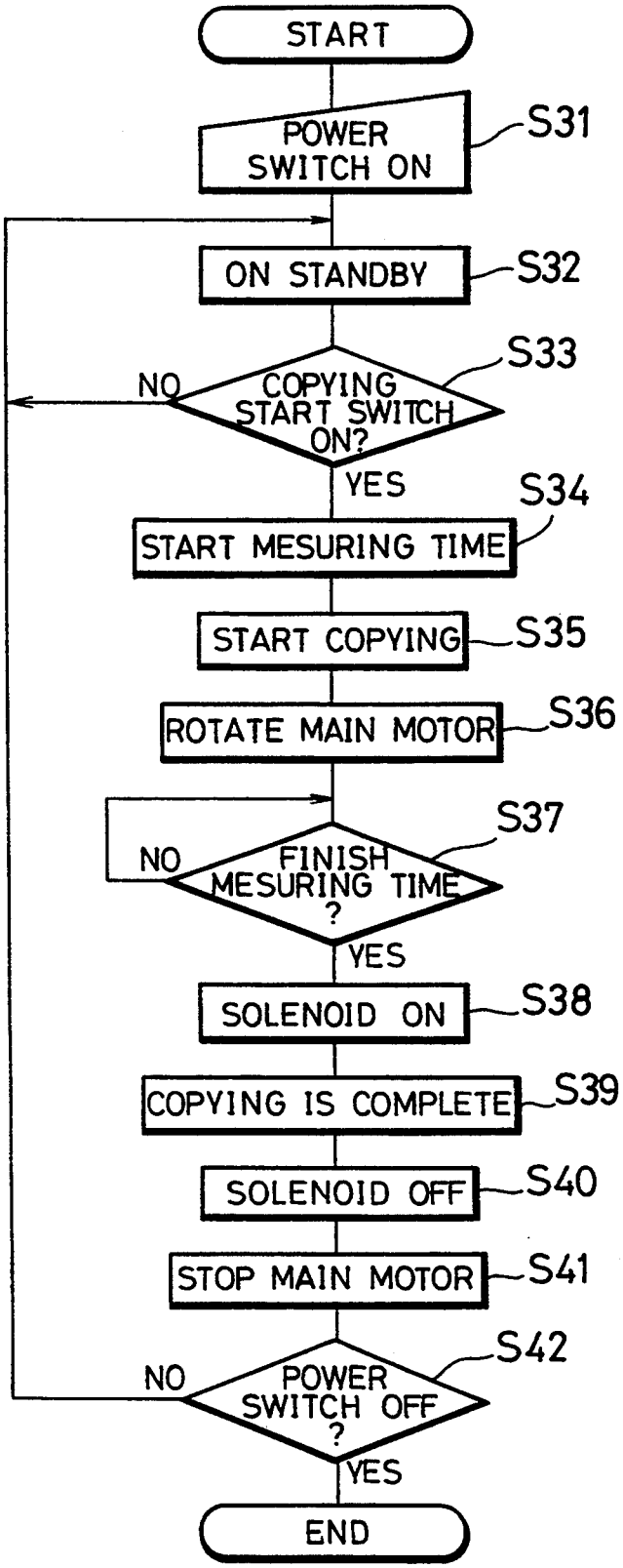
FIG. 36 is a flow chart illustrating the control of the shutter device according to the timing chart of FIG. 35.

In this copying machine, the controller 261 controls the shutter device 226 as illustrated in FIG. 36 so that, when the copying start switch 238 is turned ON (S33), the timer is actuated (S34) and a copying operation is started (S35). Subsequently, when the main motor 237 starts rotating (S36), a predetermined time $t_1$ (S37) is measured by the timer and the solenoid 230 is turned ON (S38) as illustrated in FIG. 35. As a result, the developer discharge opening 19*b* becomes open. Then, when the copying operation is complete (S39), the solenoid 230 is turned OFF (S40) and the developer discharge opening 19*b* is covered.

Namely, in this copying machine, the developer discharge opening 19*b* becomes open only for a predetermined period during the copying operation. Therefore, even when an impact is given on the developing device 8 at a time other than the predetermined period, the excessive developer D is not discharged from the developer discharge opening 19*b*.

For example, the predetermined time $t_1$ measured by the timer, i.e., the time taken to open the developer discharge opening 19*b* after starting a copying operation, is set equal to the time required by the agitating roller 21 to agitate to some extent the developer D in the developing device 8. In other words, the predetermined time $t_1$ is equal to the time taken for making a pile of the developer D in the developing device 8 substantially flat by agitating.

With this arrangement, it is possible to prevent a large amount of the developer D from spilling from the developer discharge opening 19*b* when it is open. For example, when closing the upper body which has been opened to remove a jammed sheet, the developer D sometimes gathers around the developer discharge opening 19*b* on the impact of moving the upper body of the copying machine. At this time, if the developer discharge opening 19*b* is open, a large amount of the developer D overflows through the developer discharge opening 19*b*. However, if the developer discharge opening 19*b* is opened when the predetermined time $t_1$ has passed after the copying operation is started as described above, such a drawback is overcome. The predetermined time $t_1$ is determined in accordance with the operation speed of a copying machine. For instance, it is determined to around 5 seconds in this copying machine.

Figure 37:
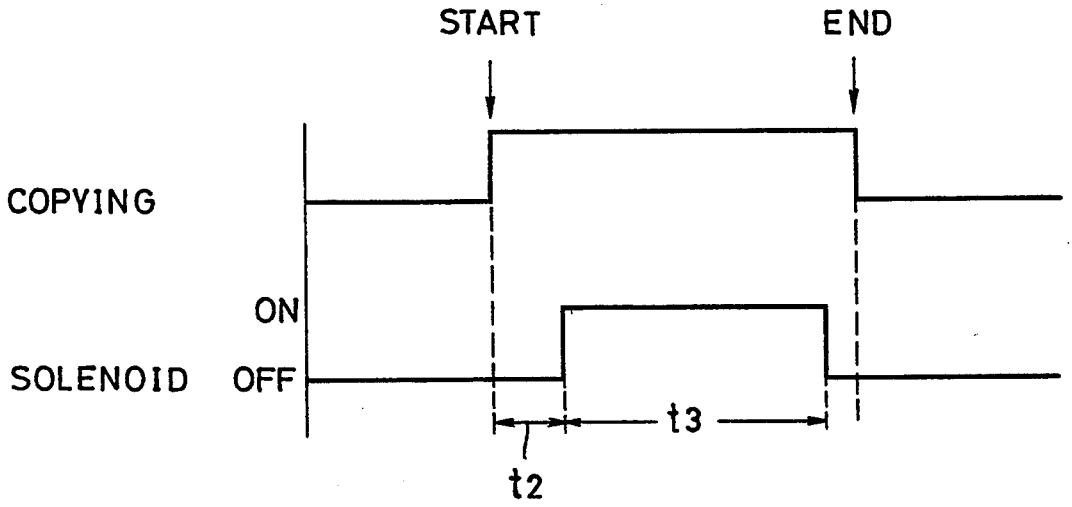
FIG. 37 is alternative timing chart for a copying operation and the actuation of the solenoid of the shutter device.
Figure 38:
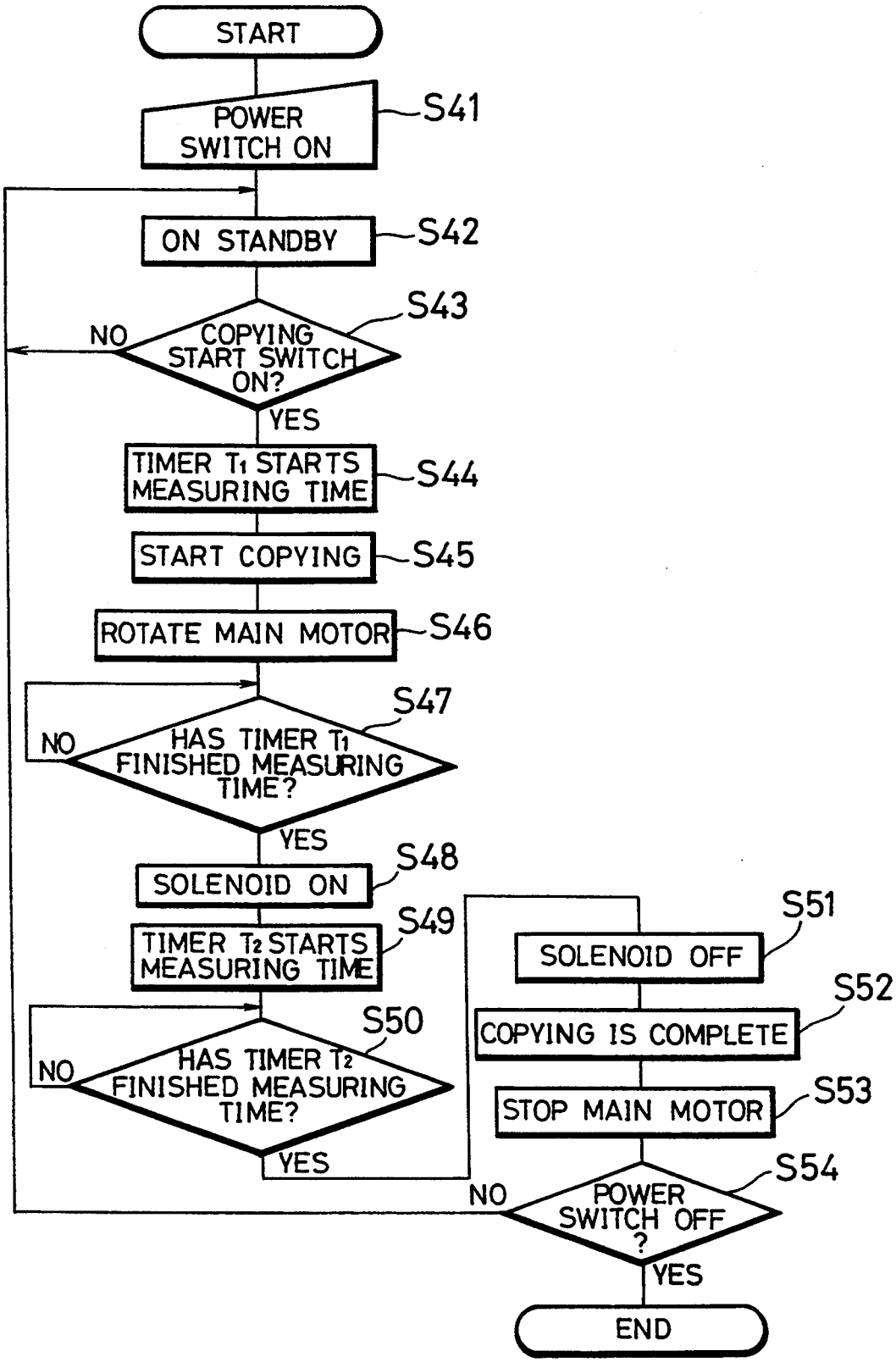
FIG. 38 is a flow chart illustrating the control of the shutter device according to the timing chart of FIG. 37.
Figure 39:
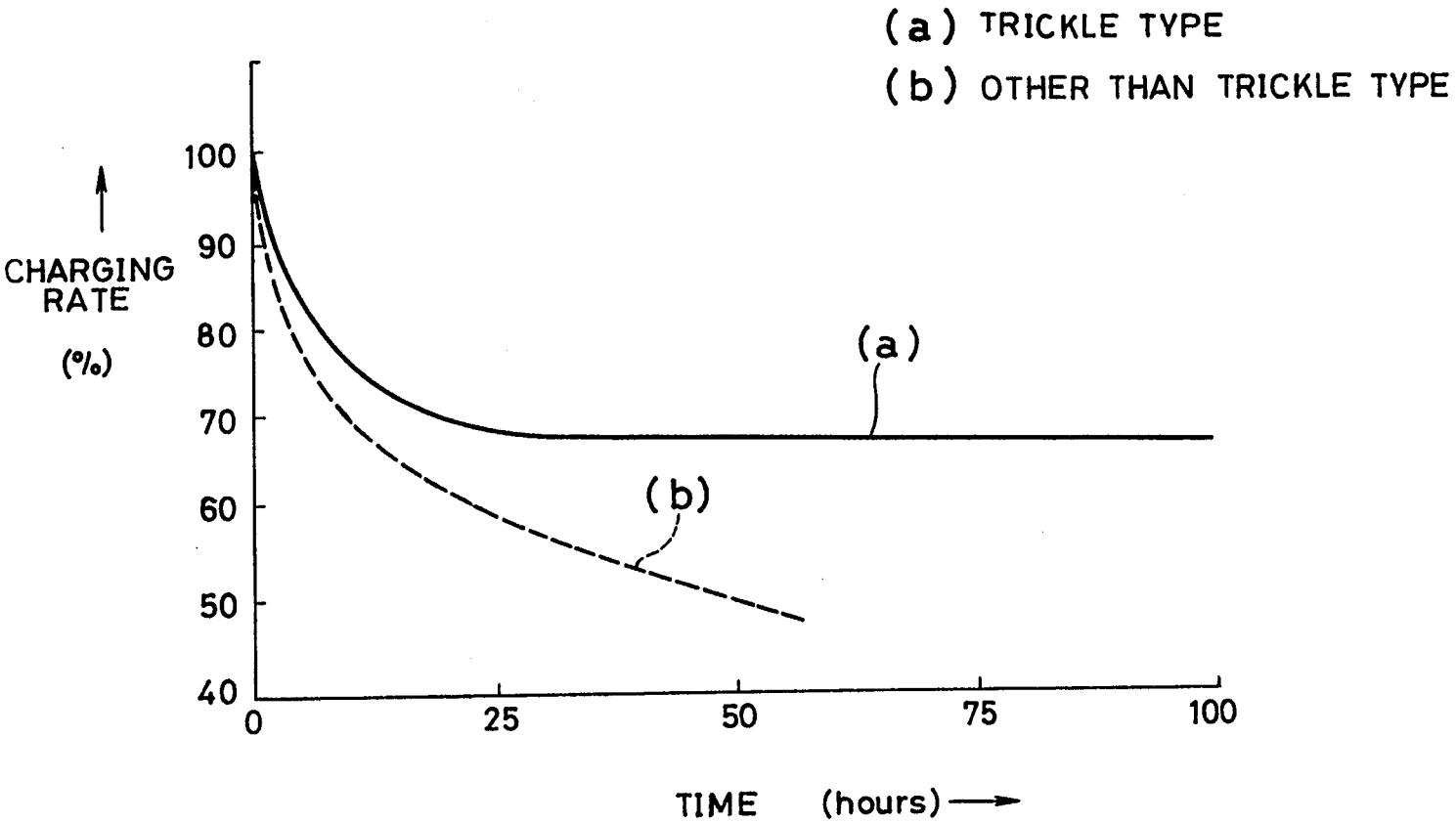
FIG. 39 is a graph illustrating the relation between the charging rate of a developer and time in a trickle-type developing device wherein the developer is gradually replaced, and that in a non-trickle-type developing device.

It is also possible to arrange the developer discharge opening 19*b* to be open only for a predetermined period during the copying operation as illustrated in FIG. 37. For example, the shutter device 226 is controlled as illustrated in FIG. 38. More specifically, when the copying start switch 238 is turned ON (S43), the timer $T_1$ is actuated (S44) and a copying operation is started (S45). Subsequently, when the timer $T_1$ measures a predetermined time $t_2$ (S47) after the main motor 237 is started rotating (S46), the solenoid 230 is turned ON (S48) as shown in FIG. 37. As a result, the developer discharge opening 19*b* becomes open. Next, when a timer $T_2$ is actuated (S49) and measures a predetermined time $t_3$ (S50), the solenoid 230 is turned OFF (S51) as shown in FIG. 37. Then the developer discharge opening 19*b* is covered and the copying operation is complete.

The predetermined time $t_2$ to be measured by the timer $T_1$ is determined in the same manner that the predetermined time $t_1$ is determined. On the other hand, the predetermined time $t_3$ to be measured by the timer $T_2$ is set to a suitable time which is shorter than the duration of the copying operation.

The switching of the solenoid 230 is not necessarily carried out based on the time measured by the timer. Switching may also be performed by other timing if the developer discharge opening 19*b* is open for a predetermined period during a copying operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic apparatus comprising:

transport path means for transporting a copy material;

an upper body which is moved upward around a supporting point to expose said transport path means;

developing means, disposed in said upper body, for developing an electrostatic latent image with a developer including toner and carrier, said carrier being gradually supplied to said developing means, and a deteriorated developer which is not reused in said developing means being gradually discharged from a developer discharge opening formed in said developing means;

shutter means for closing said developer discharge opening by an upward movement of said upper body to expose said transport path means and for opening said developer discharge opening by a downward movement of said upper body to cover said transport path means and a lower body which is positioned so that it faces said upper body and that said transport path means is sandwiched between said lower and upper bodies, wherein said shutter means comprises a movable shutter member for opening and closing said developer discharge opening and shutter driving means for moving said movable shutter member to lock said upper body with said lower body and to open said developer discharge opening when covering up said transport path means, and for moving said movable shutter member to unlock said upper and lower bodies and to close said developer discharge opening when exposing said transport path means said shutter driving means including a lock section for locking said upper body with said lower body and a driving section for moving said shutter member to open said developer discharge opening, said lock section and said driving section being formed as a single component.

2. The electrophotographic apparatus according to claim 1, further comprising:

shutter opening means for moving said shutter means, said shutter opening means being brought in contact with said shutter means by the downward movement of said upper body to open said developer discharge opening, said shutter opening means being fixed to said lower body, said developer discharge opening being covered with said shutter means when said transport path means is exposed.

3. The electrophotographic apparatus according to claim 2, wherein said shutter means comprises a movable member which has an end supported by a shaft, is pivotable around said shaft and moved between a higher position and a lower position, said movable member opening said developer discharge opening at said higher position, said movable member closing said developer discharge opening at said lower position, said shutter opening means lifts said movable member from said lower position to said higher position with the downward movement of said upper body, and wherein said movable member moves from said higher position to said lower position due to its own weight with the upward movement of said upper body.

4. The electrophotographic apparatus according to claim 3, wherein said shutter opening means includes a plate member fixed to said lower body at a position below said developing means, and wherein said movable member has an extension section extending from a free end toward said plate member.

5. The electrophotographic apparatus according to claim 4, wherein, when said transport path means is covered, an end of said extension section comes into contact with said plate member and said movable member is lifted to said higher position.

6. The electrophotographic apparatus according to claim 4, wherein said developing means comprises a wall having said developer discharge opening, said wall including a supporting section for holding said movable member at said lower position.

7. The electrophotographic apparatus according to claim 1, wherein said developing means further comprises agitating roller means for agitating the developer in said developing means, said agitating roller means being closer to said supporting point than said developer discharge opening is to said supporting point.

8. The electrophotographic apparatus according to claim 1, further comprising:

developer supply means for supplying said developer to said developing means;

developer collecting means for storing a deteriorated developer discharged from said developer discharge opening, and wherein said developer supply means and said developer collecting means are installed as a single unit.

9. The electrophotographic apparatus according to claim 1, wherein said shutter member includes a shutter for opening and closing said developer discharge opening and a lever which is pivotally supported to have first and second free ends, said shutter being attached to said first free end, said lever moving between a first position where said shutter opens said developer discharge opening and a second position where said shutter closes said developer discharge opening.

10. The electrophotographic apparatus according to claim 9, wherein said shutter driving means includes a lock section for locking said upper body with said lower body, and said lever moves from said first position to said second position due to its own weight when said upper and lower bodies are unlocked.

11. The electrophotographic apparatus according to claim 9, wherein said shutter driving means includes:

a lock section for locking said upper body with said lower body; and a driving section for moving round said lever in contact with said second free end from said second position to said first position by the downward movement of said upper body.

12. The electrophotographic apparatus according to claim 11, wherein said shutter driving means is installed in said upper body, said lower body has a joint section, and said lock section has a joining end which engages with said joint section when locking said upper body with said lower body.

13. The electrophotographic apparatus according to claim 12, wherein said shutter driving means further includes spring means for applying to said lock section a force in a direction so that said joining end of said lock section engages with said joint section.

14. The electrophotographic apparatus according to claim 11, wherein said shutter driving means is installed in said lower body, said upper body has a joint section, and said lock section has a joining end which engages with said joint section when locking said upper body with said lower body.

15. The electrophotographic apparatus according to claim 11, wherein said shutter driving means further includes an unlocking section for unlocking said upper and lower bodies.

16. The electrophotographic apparatus according to claim 15, wherein said lock section, said driving section and said unlocking section are formed as a single component and mounted pivotally in said upper body with a shaft, said lock section and said unlocking section extending opposite directions from said shaft.

17. An electrophotographic apparatus comprising:

developing means for developing an electrostatic latent image with a developer including toner and carrier, wherein said developing means is attachable to and detachable from said electrophotographic apparatus, said carrier is gradually supplied to said developing means, and a deteriorated developer which is not reused in said developing means is gradually discharged from a developer discharge opening formed in said developing means; and shutter means for opening said developer discharge opening by an installation of said developing means in said electrophotographic apparatus, and for closing said developer discharge opening by a removal of said developing means from said electrophotographic apparatus.

18. The electrophotographic apparatus according to claim 17, wherein directions in which said shutter means is moved for opening and closing said developer discharge opening are parallel to directions in which said developing means is moved when installed in or removed from said electrophotographic apparatus.

19. The electrophotographic apparatus according to claim 17, further comprising a photoreceptor drum on which said electrostatic latent image is formed, wherein said shutter means opens and closes said developer discharge opening as said developing means is moved along a central axis of said photoreceptor drum.

20. The electrophotographic apparatus according to claim 17, wherein said shutter means includes:

a shutter for opening and closing said developer discharge opening;

spring means for applying to said shutter a force in a first direction so as to close said developer discharge opening, said first direction being equal to a direction in which said developing means is moved when installed in said electrophotographic apparatus; and a stop member which comes into contact with a part of said shutter and applies to said shutter a force in a direction opposite to said first direction so as to open said developer discharge opening when installing said developing means in said electrophotographic apparatus.

21. The electrophotographic apparatus according to claim 20, wherein said shutter includes a bar-like extension section extending in said first direction, and wherein said shutter receives the force in said direction opposite to said first direction when an end of said extension section comes into contact with said stop member.

22. An electrophotographic apparatus according to claim 17, further comprising:

a photoreceptor;

and wherein said developing means is for developing said electrostatic latent image formed on said photoreceptor with said developer including toner and carrier;

cleaning means for collecting a used developer remaining on a surface of said photoreceptor;

developer collecting means for storing said used developer and a deteriorated developer which is not reused in said developing means and is gradually discharged from said developer discharge opening; and transport path means for transporting said used developer from said cleaning means to said developer collecting means.

23. An electrophotographic apparatus including:

developer collecting means for storing deteriorated developer which is gradually discharged from a developer discharge opening, said developer collecting means being attachable to and detachable from a developing means:

wherein said developer collecting means has a developer collecting opening formed in a location corresponding to said developer discharge opening, and wherein a shutter means opens said developer collecting opening formed in a location corresponding to said developer discharge opening, and wherein said shutter means opens said developer collecting opening the installation of said developer collecting means in said developing means, and closes said developer collecting opening by the removal of said developer collecting means from said developing means, and wherein said shutter means includes:

a first shutter for opening and closing said developer discharge opening;

first spring means for applying to said first shutter a force in a first direction to close said developer discharge opening, said first direction being equal to a direction in which said developer collecting means is moved when removed from said developing means, and wherein said developer collecting means includes a first side wall adjacent to said developing means, said first side wall having a first contact section which comes into contact with a part of said first shutter and applies to said first shutter a force in a direction opposite to said first direction so as to open said developer discharge opening by the installation of said developer collecting means in said developing means, and wherein such said shutter means further includes, a second shutter for opening and closing said developer collecting opening;

second spring means for applying to said second shutter a force in a direction opposite to said first direction, and wherein said developing means includes a second side wall adjacent to said developer collecting means, said second side wall having a second contact section which comes into contact with a part of said second shutter and applies to said second shutter the force in said first direction so as to open said developer collecting opening by the installation of said developer collecting means in said developing means.

24. The electrophotographic apparatus according to claim 23, wherein said first spring means includes a first guide shaft mounted on said second side wall to extend in said first direction and a first spring, said first guide shaft passing through said first spring.

25. The electrophotographic apparatus according to claim 23, wherein said second spring means includes a second guide shaft mounted on said first side wall to extend in said first direction and a second spring, said second guide shaft passing through said second spring.

26. The electrophotographic apparatus according to claim 23, wherein said second side wall further includes a second guide section for guiding said second shutter.

27. The electrophotographic apparatus according to claim 23, wherein said first side wall further includes a first guide section for guiding said first shutter.

28. The electrophotographic apparatus according to claim 23, wherein directions in which said shutter means is moved for opening and closing said developer collecting opening are parallel to directions in which said developer collecting means is moved when installed in or removed from said developing means.

29. An electrophotographic apparatus comprising:

developing means for developing an electrostatic latent image with a developer including toner and carrier, said carrier being gradually supplied to said developing means, and a deteriorated developer which is not reused in said developing means being gradually discharged from a developer discharge opening formed in said developing means;

shutter means for opening and closing said developer discharge opening;

shutter driving means for moving said shutter means between a first position and a second position, said shutter means closing said developer discharge opening at said first position and opening said developer discharge opening at said second position; and controller means for controlling said shutter driving means so that said shutter means is moved from said first position to said second position only in a predetermined period during a copying operation.

30. The electrophotographic apparatus according to claim 29, further comprising motor means for driving said developing means, wherein said predetermined period starts when said motor means is actuated and ends when said motor means is stopped.

31. The electrophotographic apparatus according to claim 29, further comprising input means through which an instruction to start a copying operation is input, wherein said predetermined period starts when said instruction is given to said controller means through said input means and ends when said motor means is stopped.

32. The electrophotographic apparatus according to claim 29, further comprising:

input means through which an instruction to start a copying operation is input;

motor means for driving said developing means; and timer means for measuring time, said timer means starts measuring the time when said instruction is given to said controller means through said input means, wherein said predetermined period starts when said timer means stops measuring time and ends when said motor means is stopped.

33. The electrophotographic apparatus according to claim 29, further comprising:

input means through which an instruction to start a copying operation is input;

first timer means for measuring a first period, said first timer means starting measuring the first period when said instruction is given to said controller means through said input means; and second timer means for measuring a second period, said second timer means starting measuring the second period when said first timer means finishes measuring the first period, wherein said predetermined period starts when said first timer means finishes measuring the first period and ends when said second timer means finishes measuring the second period.

34. The electrophotographic apparatus according to claim 29, wherein said shutter driving means includes:

solenoid means for producing a tensile force pulling said shutter means in said first direction according to an instruction from said controller means; and resilient means for pulling said shutter means in a direction opposite to said first direction, and wherein said shutter means is moved from said first position to said second position when said solenoid means produces said tensile force.

35. The electrophotographic apparatus according to claim 34, wherein said developing means includes a wall having said developer discharge opening, and said shutter means includes a shutter which pivotally slides on said wall.

36. An electrophotographic apparatus comprising:

transport path means for transporting a copy material;

an upper body which is moved upward around a supporting point to expose said transport path means;

a lower body which is positioned so that it faces said upper body and that said transport path means is sandwiched between said lower and lapper bodies, developing means, disposed in said upper body, for developing an electrostatic latent image with a developer, including toner and carrier, wherein said carrier is gradually supplied to said developing means, and a deteriorated developer which is not reused in said developing means is gradually discharged from a developer discharge opening formed in said developing means; and shutter means for closing said developer discharge opening and simultaneously locking said upper body and said lower body by an upward movement of said upper body to expose said transport path means and for opening said developer discharge opening by a downward movement of said upper body to cover said transport path means.

* * * * *